US008400387B2

(12) United States Patent
Suguro

(10) Patent No.: US 8,400,387 B2
(45) **Date of Patent: *Mar. 19, 2013**

(54) LIQUID CRYSTAL DISPLAY DEVICE

(75) Inventor: Akira Suguro, Fujimi (JP)

(73) Assignee: Citizen Holdings Co., Ltd., Nishitokyo-shi, Tokyo (JP)

( * ) Notice: Subject to any disclaimer, the term of this patent is extended or adjusted under 35 U.S.C. 154(b) by 853 days.

This patent is subject to a terminal disclaimer.

(21) Appl. No.: 12/498,690

(22) Filed: Jul. 7, 2009

(65) Prior Publication Data

US 2010/0007640 A1 Jan. 14, 2010

(30) Foreign Application Priority Data

Jul. 9, 2008 (JP) ..... 2008-178671

(51) Int. Cl.
*G09G 3/36* (2006.01)

(52) U.S. Cl. ..... 345/97; 345/204

(58) Field of Classification Search ..... 345/36, 345/45, 87

See application file for complete search history.

(56) References Cited

U.S. PATENT DOCUMENTS

| | | | | |
|---|---|---|---|---|
| 5,400,048 | A | 3/1995 | Shimada et al. | |
| 5,646,755 | A | 7/1997 | Okada et al. | |
| 5,777,593 | A | 7/1998 | Kondoh | |
| 5,838,293 | A | 11/1998 | Kondoh | |
| 6,163,360 | A | 12/2000 | Tanaka et al. | |
| 6,509,887 | B1 | 1/2003 | Kondoh et al. | |
| 6,567,065 | B1 | 5/2003 | Kondoh et al. | |
| 7,817,128 | B2 * | 10/2010 | Suguro | 345/97 |
| 2002/0191137 | A1 | 12/2002 | Kondoh | |
| 2003/0063060 | A1 | 4/2003 | Yoo et al. | |
| 2006/0012591 | A1 | 1/2006 | Suguro | |

FOREIGN PATENT DOCUMENTS

| | | | |
|---|---|---|---|
| JP | 63-212921 | A | 9/1988 |
| JP | 2001-042812 | A | 2/2001 |
| JP | 2006-030964 | A | 2/2006 |

* cited by examiner

*Primary Examiner* — Amare Mengistu
*Assistant Examiner* — Shawna Stepp Jones
(74) *Attorney, Agent, or Firm* — Westerman, Hattori, Daniels & Adrian, LLP

(57) ABSTRACT

A scanning electrode driving circuit (32) and a signal electrode driving circuit (31) of a driving circuit (30) applies, to scanning electrodes of a liquid crystal panel with a memory effect (40), a scanning voltage (TPV) in a voltage waveform composed of 0V and three values which are positive or negative unipolar (VH, VD and VS), and also applies, to signal electrodes, a signal voltage (SGV) in a voltage waveform composed of 0V and three values having a same polarity as the scanning voltage. Further, image data is displayed at a pixel of the liquid crystal panel with a memory effect (40) during three scanning periods such as a correction period for correcting the alternation, a reset period for resetting the image, and a selection period for writing new image, and in the three scanning periods, the voltage to be applied between the scanning electrode and the signal electrode is made completely alternating.

15 Claims, 13 Drawing Sheets

LIQUID CRYSTAL DISPLAY DEVICE

BACKGROUND OF THE INVENTION

1. Field of the Invention

The present invention relates to a liquid crystal display device and a driving circuit for a liquid crystal panel with a memory effect having bistable states, and particularly to a liquid crystal display device in which a memory effect presented by bistable states of a liquid crystal having a memory effect is utilized to enable operation at a low voltage and reduce the power consumption.

2. Description of the Related Art

As a display device of a personal digital assistant in which the display screen is not often switched, such as used in an electronic book or electronic newspaper which has recently received much attention, a liquid crystal panel with a memory effect using a liquid crystal having a memory effect has drawn attention. Having a memory effect means that a display image on the panel can be maintained even during no power consumption.

Using the characteristics enables reduction in the power consumption of the liquid crystal display device. A ferroelectric liquid crystal, a cholesteric liquid crystal, and so on are known as materials of the liquid crystal for use in the liquid crystal panel with a memory effect.

Such a liquid crystal panel with a memory effect has a liquid crystal having a memory effect having at least bistable sates between a pair of substrates (glass substrates) which have scanning electrodes and signal electrodes on their opposed surfaces, respectively.

FIG. 5 is a plane view of enlarged portion of the scanning electrodes and signal electrodes as seen from a direction perpendicular to the substrate surface of the liquid crystal panel, in which TP1 to TP4 are scanning electrodes and SG1 to SG4 are signal electrodes. A liquid crystal having a memory effect exists between the scanning electrodes and the signal electrodes, and portions where the scanning electrodes TP1 to TP4 are opposed to the signal electrodes SG1 to SG4 with the liquid crystal having a memory effect intervening therebetween (portions where the scanning electrodes TP1 to TP4 overlap the signal electrodes SG1 to SG4 in FIG. 5) form pixels Pix (x, y), respectively.

FIG. 6 is showing the relation between the voltage applied to a liquid crystal panel and the transmittance thereof, and bistable states of the ferroelectric liquid crystal, when a ferroelectric liquid crystal and a pair of polarizing film (not shown) are arranged.

The ferroelectric liquid crystal has bistable states, which are switched by applying a positive or negative voltage exceeding a threshold value +Vt or −Vt, so that the first ferroelectric state (ON state) or the second ferroelectric state (OFF state) can be selected depending on the polarity of the applied voltage.

More specifically, during application of no voltage, the ferroelectric liquid crystal exits bistable states in the first or the second ferroelectric state, however for example, when the applied voltage exceeds the threshold value +Vt on the positive side while the ferroelectric liquid crystal is stable in the second ferroelectric state (the black image state with a low transmittance), the ferroelectric liquid crystal is brought into the first ferroelectric state (the white image state with a high transmittance). Even if the applied voltage is gradually decreased to no voltage (0V) from that state, the first ferroelectric state is maintained.

However, when the applied voltage exceeds the threshold value −Vt on the negative side while the liquid crystal is stable in the first ferroelectric state (the white image state with a high transmittance), the liquid crystal molecule is brought into the second ferroelectric state (the black image state with a low transmittance). Even if the applied voltage is gradually increased to no voltage (0V) from that state, the second ferroelectric state is maintained.

As is clear from the chart, the liquid crystal panel using the ferroelectric liquid crystal can maintain the transmittance, that is, the display state even during application of no voltage, that is, no power consumption. The characteristics mean having a memory effect.

Incidentally, the liquid crystal panel in which the pixels Pix (x, y) are formed in a matrix form as shown in FIG. 5 typically performs rewrite a screen for the multiplex driving method.

More specifically, a scanning voltage is outputted from a scanning electrode driving circuit (not shown) sequentially to the scanning electrodes TP1 to TP4 line by line, for example, to TP1, TP2, and so on, in synchronization with which, a signal voltage is outputted from a signal electrode driving circuit (not shown) to signal electrodes SG1 to SG4 in a parallel manner. Note that the signal voltage becomes in a voltage waveform corresponding to image data to be displayed at each of the pixels Pix (x, y).

Further, a pair of polarizing film (not shown) are arranged outside the liquid crystal panel such that their absorption axes are in a crossed-Nicols state so as to create the white image in the above-described ON state and the black image in the OFF state.

Next, a conventional driving method for bringing the pixels in such a ferroelectric liquid crystal panel into the white image or the black image will be described using FIG. 14. FIG. 14 shows a driving voltage waveform and a transmittance curve of a typical ferroelectric liquid crystal panel when a pixel Pix (1, 1) at the first row and first column in FIG. 5 is brought into the white image ON (W) and the black image OFF (B). In the FIG. 14, TP1 is a voltage waveform applied to the scanning electrode TP1, and SG1 is a voltage waveform applied to the signal electrode SG1.

To bring the pixel Pix (1, 1) at the first row and first column shown in FIG. 5 into the white image, during a period for displaying one screen, a reset period RS is set at the first portion, and a selection period SE for determining the display state and a non-selection period NSE for maintaining the display state are set thereafter.

First, during the reset period RS, a driving circuit outputs bipolar pulses of voltage values +VRT and −VRT as the scanning voltage to the scanning electrode TP1, and bipolar pulses of voltage values +VRS and −VRS as the signal voltage to the signal electrodes SG1.

Thereby, during the reset period RS a voltage in a composite voltage made by adding the scanning voltage to the signal voltage, so that reset pulses of the voltage values (VRT+VRS) and −(VRT+VRS) as the composite voltage waveform TS (1, 1) are applied to the pixel Pix (1, 1).

As for the transmittance, as shown at TV (1, 1), the pixel Pix (1, 1) is brought into the first ferroelectric state, that is, the white image with a high transmittance during the first half of the reset period RS because the reset pulse becomes the positive voltage exceeding the threshold value +Vt on the positive side described with FIG. 6, whereas the pixel Pix (1, 1) is brought into the second ferroelectric state, that is, the black image with a low transmittance during the second half of the reset period RS because the reset pulse becomes the negative voltage exceeding the threshold value −Vt on the negative side.

Subsequently, during the selection period SE, the driving circuit outputs a voltage value 0V and bipolar pulses at −VS and +VS as the scanning voltage to the scanning electrode TP1, and outputs a voltage value 0V and bipolar pulses at +VD and −VD as the signal voltage to the signal electrode SG1.

Thereby, the composite voltage obtained by adding the scanning voltage to the signal voltage is applied during the selection period SE and therefore becomes the selection pulses at voltage values 0V, −(VS+VD), and +(VS+VD) as shown in the composite voltage waveform TS (1, 1), and the voltage is applied to the pixel Pix (1, 1).

As for the transmittance, since the positive voltage exceeding the threshold value +Vt on the positive side described with FIG. 6 is applied as the selection pulse in the second half of the selection period SE, the second ferroelectric state is changed to the first ferroelectric state, that is, the white image with a high transmittance as shown at TV (1, 1).

Further, during the non-selection period NSE, the driving circuit outputs the voltage value 0V as the scanning voltage to the scanning electrode TP1, and the voltage value 0V or bipolar pulses at −VD and +VD as the signal voltage to the signal electrode SG1.

Thereby, the composite voltage obtained by adding the scanning voltage to the signal voltage is applied to between the scanning electrode TP1 and the signal electrode SG1 during the non-selection period NSE. Therefore the composite voltage waveform TS (1, 1) becomes the voltage value 0V or the bipolar signal pulses at −VD and +VD, and the voltage is applied to the pixel Pix (1, 1).

As for the transmittance, since the voltage of the signal pulse is smaller in absolute value than the threshold value +Vt or −Vt described with FIG. 6 during the non-selection period NSE, the first ferroelectric state determined during the selection period SE, that is the white image with a high transmittance is maintained as shown at TV (1, 1).

Note that the pulse shown by a square in the non-selection period NSE which is the voltage waveform applied to the signal electrode SG1 in FIG. 14 shows bipolar pulses at either +VD and −VD or −VD and +VD.

As described above, in the conventional driving method, the driving voltage applied between the scanning electrode and the signal electrode is composed of the reset pulses, the selection pulses and holding pulses so that any DC component does not remain during a period for displaying one screen, thereby prevent deterioration in image quality. However, the driving voltage requires nine level values (0V, ±VS, ±VD, ±VRS, and ±VRT). Further, because of bipolar pulses, the peak-peak value (±(VRT+VRS) in FIG. 14) needs to be twice the voltage to which the liquid crystal reacts.

As described above, according to the conventional driving method, many voltage values and high voltage values have been required to drive the liquid crystal panel with a memory effect, leading to complicated configurations of the scanning electrode driving circuit (row driver IC) for outputting the scanning voltage and the signal electrode driving circuit (column driver IC) for outputting the signal voltage, moreover leading to require an IC of high-voltage process, therefore the display device has been high cost.

Hence, the inventor previously invented a liquid crystal display device and a driving circuit for a liquid crystal panel with a memory effect disclosed in Patent Document 1.
disclosed in Patent Document 1.

According to that invention, the driving circuit driving the liquid crystal panel with a memory effect to cause pixels to display image data is configured to apply voltages (showing for convenience, scanning electrodes TP1 and TP2, signal electrodes SG1 and so on in FIG. 15) in driving waveforms each composed of a voltage value 0V and positive or negative unipolar voltage (positive unipolar voltage shown in FIG. 15) to all of the scanning electrodes and the signal electrodes of the liquid crystal panel with a memory effect.

Further, the image data displayed at each pixel is displayed during a plurality of scanning periods F1 and F2, and composite voltage waveforms (TP1-SG1), (TP2-SG1) as shown in FIG. 15 such the composite voltages made by adding the scanning voltage to the signal voltage are applied to the pixels TS(1, 1), TS(2, 1), then the applied voltages are made alternating in the plural scanning periods.

Thus, it is possible that the driving waveforms of the scanning voltage and the signal voltage outputted from the driving circuit to drive the liquid crystal panel with a memory effect become positive or negative unipolar, the number of the voltage levels constituting the voltage waveforms, that is, the kinds of the voltage values of both the scanning voltage and the signal voltage are three or four values, and the voltage waveforms can be made by simple circuit.

Accordingly, the scanning electrode driving circuit (row driver IC) and the signal electrode driving circuit (column driver IC) can be reduced in size and manufactured at low cost. This allows a liquid crystal display device having the liquid crystal panel with a memory effect to be provided at low cost.

Patent Document 1: JP 2006-30964A (US 2006/0012591 A1)

As described above referring FIG. 15, the liquid crystal display device and the driving circuit for the liquid crystal panel with a memory effect disclosed in Patent Document 1 are configured to display the image data displayed at each pixel of the liquid crystal panel with a memory effect during the plural scanning periods, that is, the first scanning period F1 and a subsequent scanning period F2, and the voltage applied between the scanning electrode and the signal electrode at a portion forming the pixel is made alternating in the plural scanning periods F1 and F2.

The scanning period F1 is composed of a reset period RS for bringing the liquid crystal having a memory effect at each pixel into a first stable state, a selection period SE1 for bringing it into the first stable state or a second stable state, and a holding period NSE1 for holding the stable state thereafter, and during the scanning period F2, the stable state held during the scanning period F1 is maintained as it is.

Here, in either case in which the pixel is brought into the white image or the black image, the pulse waveform of the signal voltage applied to the signal electrode during the reset period and the pulse waveform of the scanning voltage applied to the scanning electrode during the selection period are made the same waveform with the same pulse width and same pulse voltage value, whereby the polarity of the composite voltage applied between the scanning electrode and the signal electrode can be inverted during the reset period and the selection period.

Incidentally, in the composite voltage waveform (TP2-SG1) when the black image is selected, the absolute value of the positive selection pulse is smaller than the absolute value of the negative reset pulse. Accordingly, to appropriately make alternating also for this portion, the scanning period F2 is provided after the scanning period F1.

More specifically, the potential being reference (reference potential) is made different between the scanning period F1 and the scanning period F2 in the driving waveforms of both the scanning voltage and the signal voltage, so that the complete alternating driving is compensated during the two scanning periods.

If the selection period for selecting the stable state of the pixel of the liquid crystal having a memory effect according to the image data is placed in the first scanning period F1 as described above, the signal pulse at the voltage value VD composed of one of positive or negative polarity is kept applied during the subsequent scanning period F2.

When even such a small pulse is continuously applied, the memory effect of the liquid crystal layer deteriorates, leading to a problem of a change in image. Further, since the driving waveform having a reference potential varying each scanning period, the driving circuit is complicated.

SUMMARY OF THE INVENTION

The invention has been developed in consideration of the above background, and its object is to make the driving voltage outputted from a driving circuit (driver IC) driving the liquid crystal panel with a memory effect unipolar and to eliminate use of a high-voltage element so as to reduce the cost and improve the display quality using a simple driving circuit, similarly to the invention disclosed in Patent Document 1.

A liquid crystal display device according to the invention is a liquid crystal display device including a liquid crystal panel with a memory effect including a liquid crystal having a memory effect such as a ferroelectric liquid crystal or the like having at least bistable states sandwiched between a pair of substrates having scanning electrodes and signal electrodes on opposed surfaces respectively, portions thereof where the scanning electrodes are opposed to the signal electrodes with the liquid crystal having a memory effect intervening therebetween forming pixels; and a driving circuit for driving the liquid crystal panel with a memory effect to cause the pixels to display image data, which is characterized in that it is configured as follows in order to attain the above-described object.

The driving circuit applies, to the scanning electrode of the liquid crystal panel with a memory effect, a scanning voltage in a voltage waveform composed of a voltage value 0V (zero volt) and only one of positive or negative unipolar voltage value consistently across a plurality of scanning periods, and also, to the signal electrode, a signal voltage in a voltage waveform composed of a voltage value 0V and a unipolar voltage value having the same polarity as the polarity of the scanning voltage consistently across a plurality of scanning periods.

The image data displayed at the pixel is displayed during the plurality of scanning periods, and the voltage applied between the scanning electrode and the signal electrode at a portion forming the pixel is made alternating during the first scanning period and the subsequent scanning periods which are the plurality of scanning periods.

Further, the plural scanning periods are composed of a selection period for applying a selection pulse between the electrodes to cause the pixel to display, a reset period for applying a reset pulse between the electrodes to reset a state of the pixel before the selection period, and a correction period for applying a correction pulse for the alternation placed before the reset period.

A composite waveform of the voltage waveform of the scanning voltage and the voltage waveform of the signal voltage outputted by the driving circuit may be a waveform of a composite voltage applied between the scanning electrode and signal electrode at the portion forming the pixel. In this case, the liquid crystal having a memory effect at the pixel is brought into one stable state of bistable states in the correction period of the plural scanning periods, the liquid crystal having a memory effect is brought into the other stable state in the reset period, and the liquid crystal having a memory effect is brought into the one or the other stable state in the selection period.

Therefore, the waveform of the composite voltage has the correction pulse in the correction period, has the reset pulse in the reset period, and the selection pulse in the selection period.

It is preferable that the reset pulse is composed of the voltage waveform of the signal voltage with the scanning voltage being 0V, the selection pulse is composed of the voltage waveform of the signal voltage and the voltage waveform of the scanning voltage, and the correction pulse is mainly composed of the voltage waveform of scanning voltage.

The reset pulse preferably has an actual pulse width at least twice the selection pulse. The scanning voltage and the signal voltage in the voltage waveforms generating the pulses are desirably applied to the scanning electrodes and the signal electrodes respectively line by line in the correction period, the reset period and the selection period.

It is desirably that each of the voltage waveform of the scanning voltage and the voltage waveform of the signal voltage outputted by the driving circuit is composed of four values which are a first positive or negative voltage value (VS) that is larger in absolute value than a threshold value at which the stable state of the liquid crystal having a memory effect changes, a second voltage value (VD) that is the same in polarity as the first voltage value and smaller in absolute value than the threshold value, a third voltage value (VH) that is the same in polarity as the second voltage value and smaller in absolute value than the second voltage value, and a voltage value 0V.

It is preferable that the second voltage value (VD) is ½ of the first voltage value (VS), and the third voltage value (VH) is ¼ of the first voltage value (VS).

It is preferable that in the selection period, the voltage waveform of the signal voltage is composed of the second voltage value (VD) and the voltage value 0V. Further, in the selection period, the voltage waveform of the scanning voltage preferably is composed of the third voltage value (VH), the first voltage value (VS) and the voltage value 0V only in a period selected with time division and is composed of the third voltage value (VH) and the voltage value 0V in a period other than the selection pulse.

In the correction period, the reset period and the selection period, reference potentials of the scanning voltage and the signal voltage outputted by the driving circuit can be 0V at all times. Any of the correction period, the reset period and the selection period can be one scanning period in which the whole screen of the liquid crystal panel with a memory effect is rewritten one time.

The correction pulses are simultaneously applied between all of the scanning electrodes and all of the signal electrodes in the correction period, and the reset pulses are simultaneously applied between all of the scanning electrodes and all of the signal electrodes in the reset period, whereby the time for updating the screen can be reduced.

The scanning voltage and the signal voltage in the voltage waveforms generating the selection pulse are applied sequentially to the scanning electrodes and the signal electrodes respectively line by line in the selection period, and a pause period during which a voltage value 0V is applied to both of the scanning electrode and the signal electrode is provided between the lines to which the voltages are applied, whereby occurrence of an error image can be prevented. The length of the pause period is desirably equal to or greater than the width of the selection pulse.

It is desirably that any of the above-described liquid crystal display devices further has a scanning electrode driving circuit for applying the scanning voltage to the scanning electrode; and a signal electrode driving circuit for applying the signal voltage to the signal electrode, wherein the scanning electrode driving circuit and the signal electrode driving circuit have the same circuit configuration and are compatible with each other.

According to the invention, each of the voltage waveforms of the scanning voltage and the signal voltage outputted by the driving circuit to drive the liquid crystal panel with a memory effect can be unipolar, that is, positive or negative, the number of levels of the voltages forming each of the voltage waveforms, that is, the kinds of the voltage values can be four values even including both the scanning voltage and the signal voltage, and each of the voltage waveforms can be made simple.

Further, the scanning electrode driving circuit and the signal electrode driving circuit (driver ICs) can be reduced in size and manufactured at low cost because it is unnecessary to change the reference potential of the scanning voltage and the signal voltage, while realizing the complete alternation of the voltage waveform to be applied to the liquid crystal having a memory effect. This allows a liquid crystal display device provided with the liquid crystal panel with a memory effect to be provided at low cost.

In addition, the pulse waveform at the voltage value VD sufficiently smaller than the selection pulse and composed of both positive and negative polarities is applied as the composite voltage in the scanning period after the selection period for selecting the stable state of the pixel of the liquid crystal having a memory effect according to the image data. As described above, a pulse composed of one polarity is not continuously applied, so that the high display quality can be held for a long time.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, a liquid crystal display device according to the invention will be described in detail with reference to the accompanying drawings. An embodiment of the invention will be described using FIG. 1 to FIG. 4 and FIG. 7 to FIG. 13 as well as the above-described FIG. 5 and FIG. 6.

Figure 1:
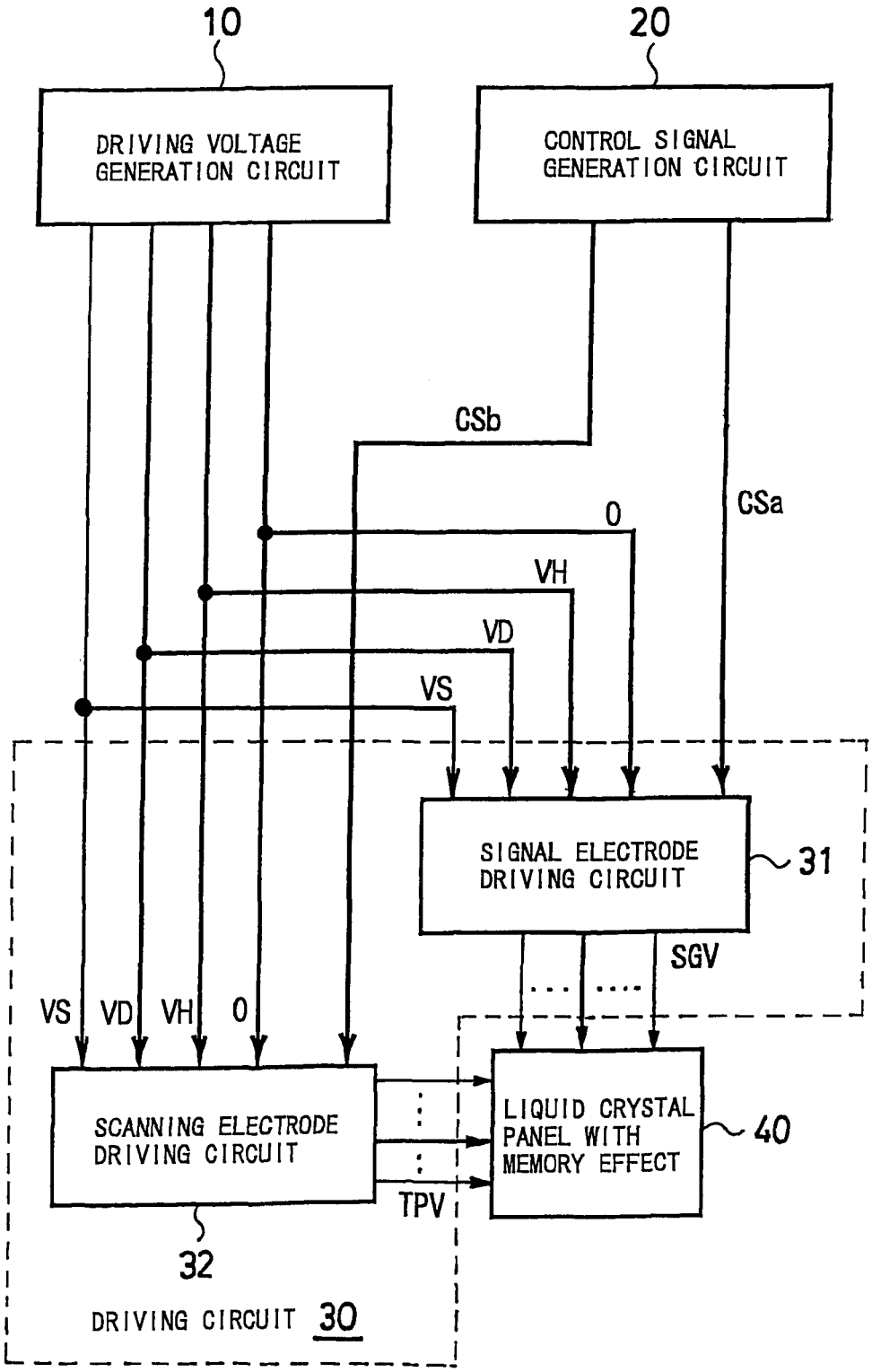
FIG. 1 is a block configuration diagram showing an embodiment of a liquid crystal display device according to the invention.
Figure 2:
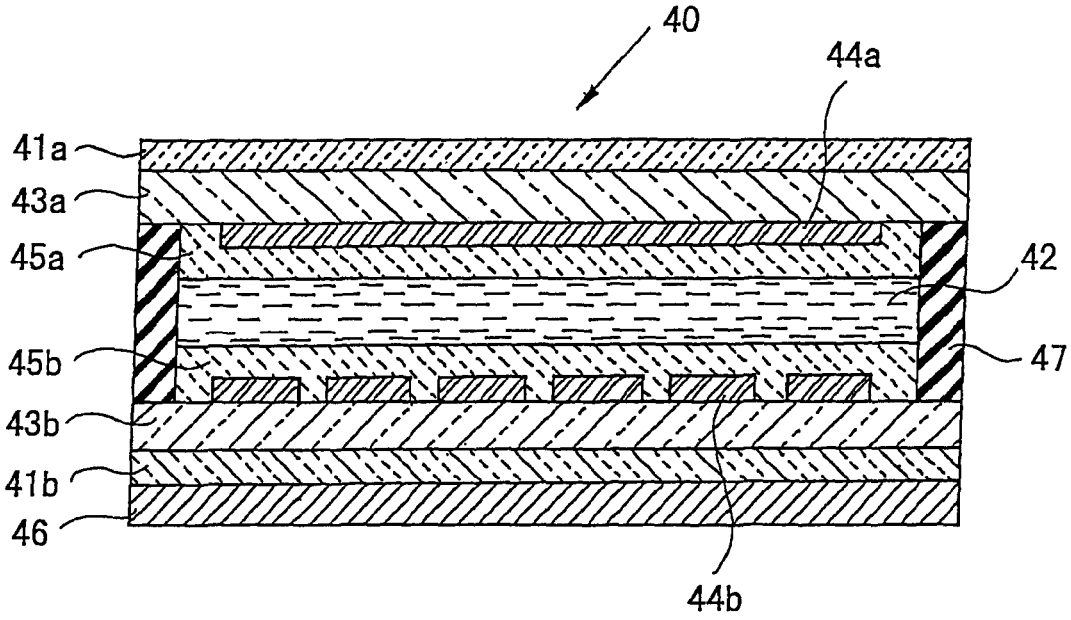
FIG. 2 is a schematic cross-sectional view showing a configuration of a liquid crystal panel with a memory effect in FIG. 1.

FIG. 1 is a block diagram showing an embodiment of the liquid crystal display device according to the invention, and FIG. 2 is a schematic cross-sectional view showing the configuration of its liquid crystal panel with a memory effect. It should be noted that FIG. 2 shows the panel with the dimension in the thickness direction being significantly enlarged and the ratio between thicknesses of portions thereof being not precise.

Figure 3:
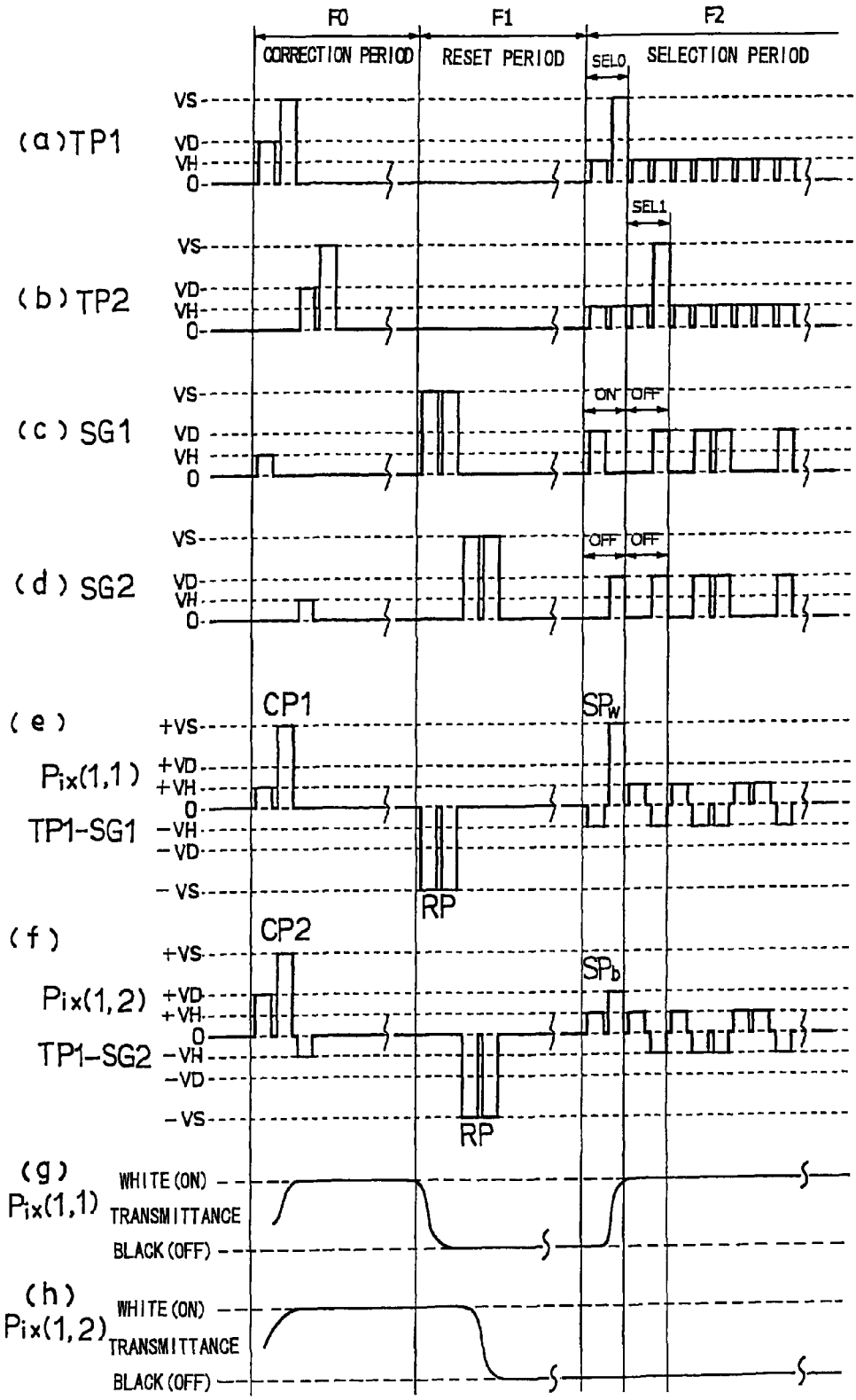
FIG. 3 is a waveform chart showing the relation between the driving voltage waveform to be applied to the liquid crystal panel with a memory effect and the transmittance in the liquid crystal display device shown in FIG. 1.
Figure 4:
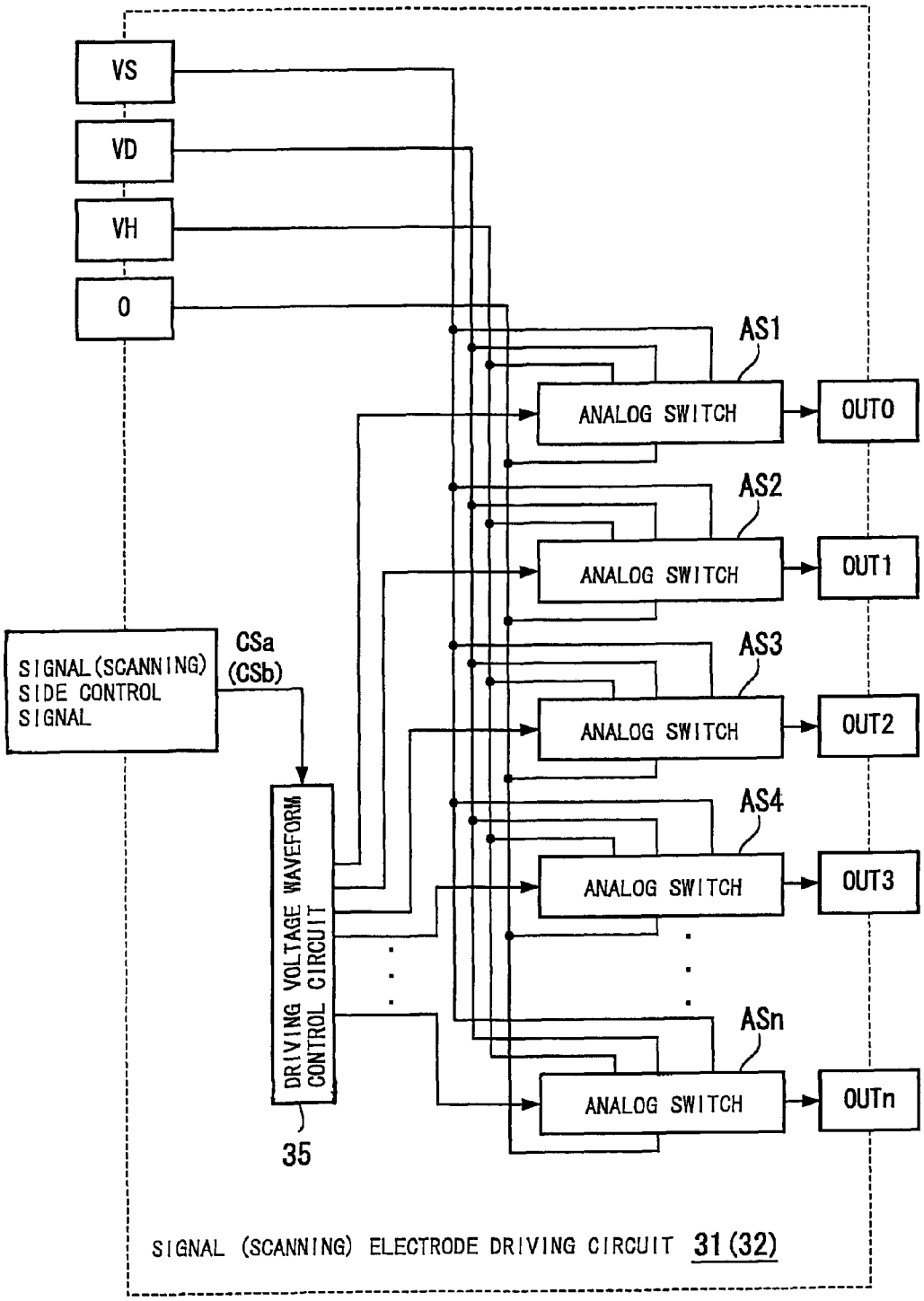
FIG. 4 is a block circuit diagram showing concrete examples of a scanning electrode driving circuit and a signal electrode driving circuit constituting the driving circuit in FIG. 1.

FIG. 3 is a waveform chart showing the relation between the driving voltage waveform to be applied to the liquid crystal panel with a memory effect in the liquid crystal display device shown in FIG. 1 and the transmittance, and FIG. 4 is a block circuit diagram showing concrete examples of a scanning electrode driving circuit and a signal electrode driving circuit constituting the driving circuit in FIG. 1.

The liquid crystal display device shown in FIG. 1 is composed of a driving voltage generation circuit 10, a control signal generation circuit 20, a driving circuit 30 composed of a signal electrode driving circuit 31 and a scanning electrode driving circuit 32, and a liquid crystal panel with a memory effect 40.

The driving voltage generation circuit 10 generates voltages of four values with the same polarity and different in level, that is, voltage values 0V, VH, VD, and VS, and supplies the voltages to each of the signal electrode driving circuit 31 and the scanning electrode driving circuit 32 of the driving circuit 30.

The control signal generation circuit 20 generates a signal side control signal CSa and a scan side control signal CSb according to image data, and inputs the signal side control signal CSa to the control terminal of the signal electrode driving circuit 31 and inputs the scan side control signal CSb to the control terminal of the scanning electrode driving circuit 32, respectively.

Figure 6:
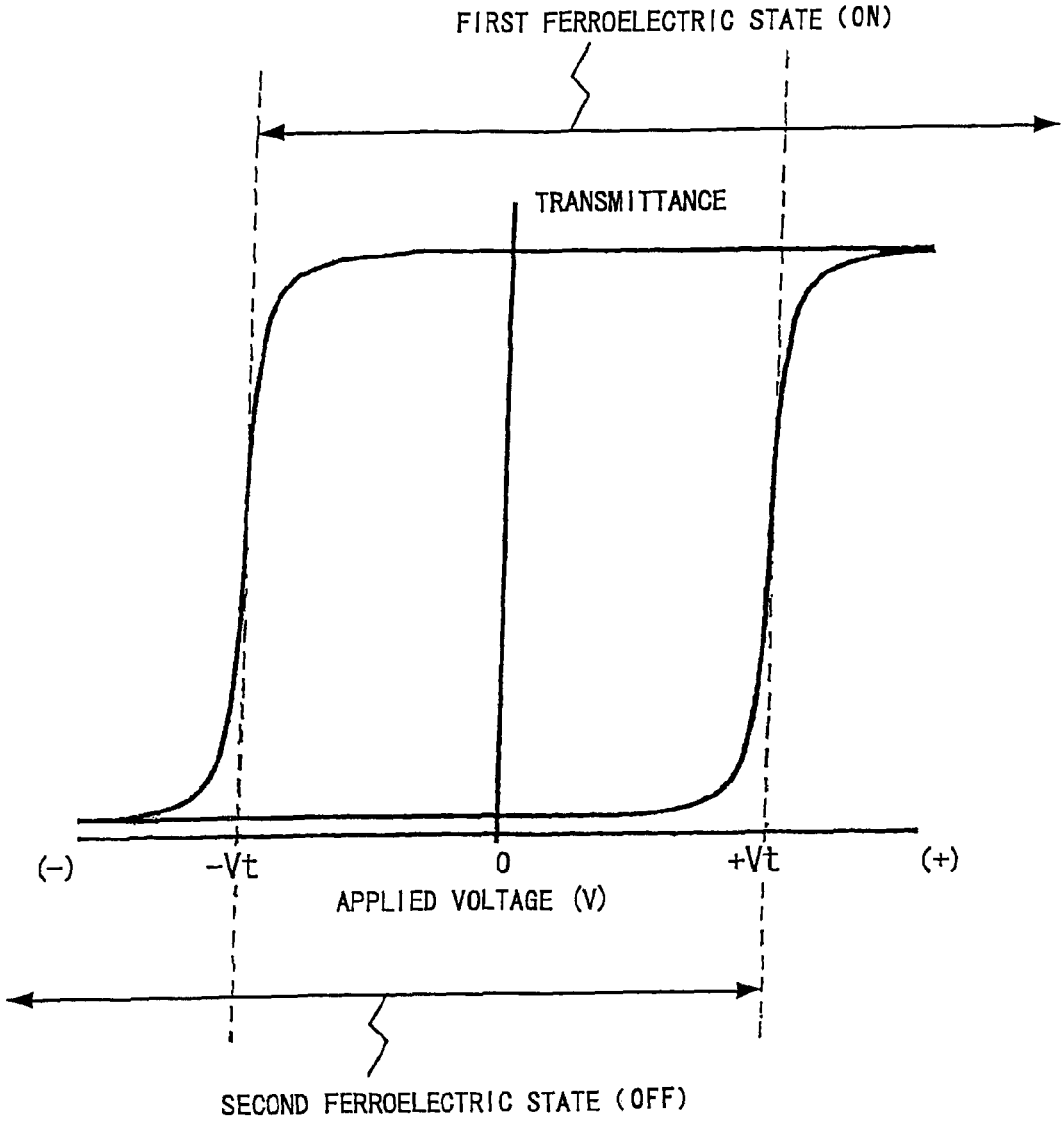
FIG. 6 RELATED ART
FIG. 6 is a chart showing the relation between the voltage applied to a liquid crystal panel when a ferroelectric liquid crystal and a pair of polarizing film are arranged, the transmittance, and bistable states of the ferroelectric liquid crystal.

Among the voltages of the four values generated by the driving voltage generation circuit 10, the first voltage value VS is a positive or negative voltage value larger in absolute value than a threshold value −Vt or +Vt at which the stable state of the liquid crystal having a memory effect changes as described with FIG. 6, the second voltage value VD is a voltage value having the same polarity as that of the first voltage value VS and smaller in absolute value than the threshold value −Vt or +Vt, and the third voltage value VH is a voltage value having the same polarity as that of the second voltage value VD and smaller in absolute value than the second voltage value VD.

In the example which will be described later using FIG. 3, the second voltage value VD is ½ (=2/4) of the first voltage value VS, and the third voltage value VH is ¼ of the first voltage value VS.

The signal electrode driving circuit 31 in the driving circuit 30 in FIG. 1 is controlled by the signal side control signal CSa to sequentially select required voltages from among the voltage values 0V, VH, VD and VS outputted from the driving voltage generation circuit 10, and applies a signal voltage SGV having a voltage waveform which is described later using FIG. 3, as the signal side driving signal, to many signal electrodes (for example, 160 electrodes) of the liquid crystal panel with a memory effect 40 in a parallel manner.

On the other hand, the scanning electrode driving circuit 32 is controlled by the scan side control signal CSb to sequentially select required voltages from among the voltage values 0V, VH, VD and VS outputted from the driving voltage generation circuit 10, and applies a scanning voltage TPV having a voltage waveform which is described later using FIG. 3, as the scan side driving signal, to many scanning electrodes (for example, 128 electrodes) of the liquid crystal panel with a memory effect 40 in a sequential manner.

Then, the driving circuit 30 synchronizes the signal voltage SGV and the scanning voltage TPV to drive the liquid crystal panel with a memory effect 40 so as to cause each pixel to display image data.

Because the signal electrode driving circuit 31 and the scanning electrode driving circuit 32 can be similarly configured and the circuits can be configured only by making the logic circuits of their output portions different, leading to easier design and reduced cost. Concrete examples thereof will be described later.

The liquid crystal panel with a memory effect 40 is constituted as shown in FIG. 2. This is the same configuration as that of a typical liquid crystal panel with a memory effect, in which a pair of glass substrates 43*a* and 43*b* holding a liquid crystal layer with a memory effect 42 having a thickness of about 2 μm are bonded together with a sealing agent 47 with a fixed gap (about 2 μm) held therebetween.

The opposed surfaces of the pair of glass substrates 43*a* and 43*b* are formed with scanning electrodes 44*a* and signal electrodes 44*b* made of a transparent electrode (ITO) in the form of a plurality of stripes, arranged in directions perpendicular to each other so as to form many pixels in a dot-matrix form, on which alignment films 45*a* and 45*b* are formed respectively and subjected to alignment treatment.

Figure 5:
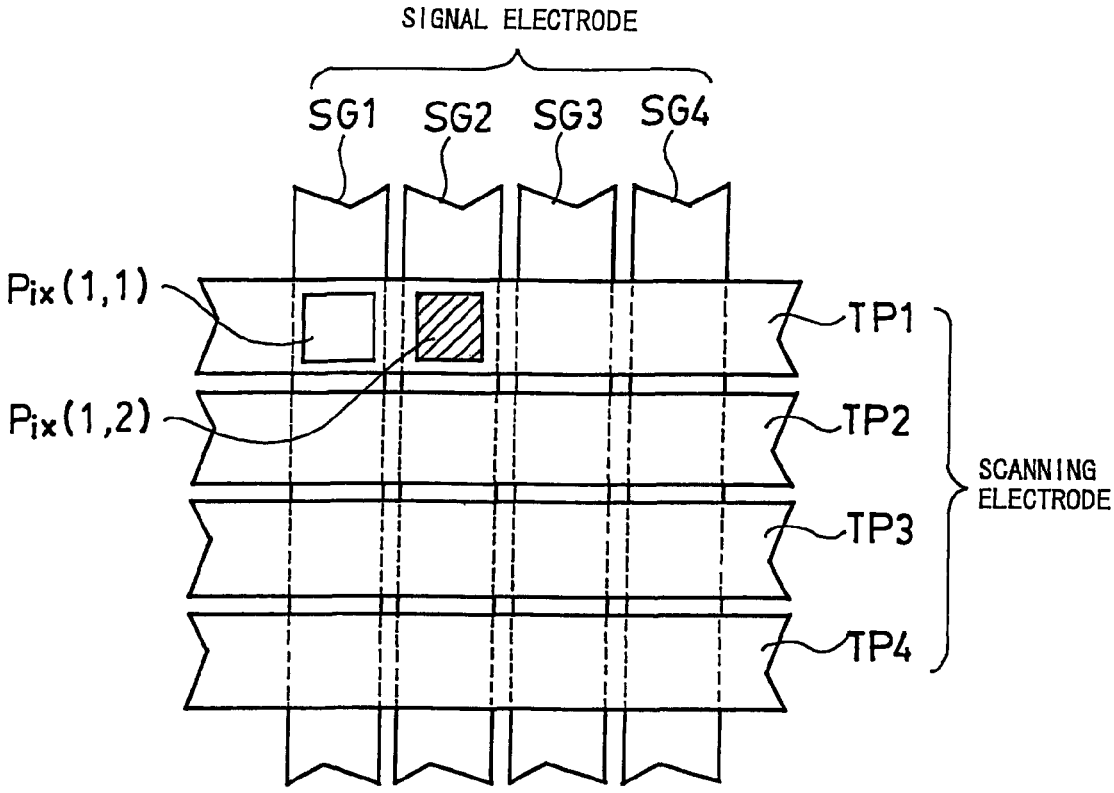
FIG. 5 RELATED ART
FIG. 5 is a plane view of enlarged portion of scanning electrodes and signal electrodes of a liquid crystal panel with a memory effect in which pixels are formed in a matrix form, as seen from a direction perpendicular to the substrate surface of the liquid crystal panel.

Portions where the scanning electrodes 44*a* and the signal electrodes 44*b* are opposed to each other with the liquid crystal layer with a memory effect 42 intervening therebetween, that is, portions where the scanning electrodes 44*a* and the signal electrodes 44*b* planarly overlap each other as shown in FIG. 5 form pixels Pix, respectively. Note that a part of the scanning electrodes is shown by TP1 to TP4 and a part of the signal electrodes is shown by SG1 to SG4 in FIG. 5.

As the liquid crystal used for the liquid crystal layer with a memory effect 42, a ferroelectric liquid crystal, a cholesteric liquid crystal and so on can be employed.

Further, outside one glass substrate 43*a*, a first polarizing film 41*a* is provided. Outside the other glass substrate 43*b*, a second polarizing film 41*b* is provided such that its polarization axis is different by 90° from (perpendicular to) that of the first polarizing film 41*a*. Outside the second polarizing film 41*b*, a reflector 46 is disposed.

The first polarizing film 41*a* and the second polarizing film 41*b* are absorption-type polarizing film s which absorb linearly polarized light whose polarization direction is parallel to their absorption axes and transmit linearly polarized light whose polarization direction is parallel to their polarization axes (transmission axes) perpendicular to the absorption axes.

However, instead of the second polarizing film 41*b* and the reflector 46, a reflection-type polarizing film with a polarization function may be provided. The reflection-type polarizing film has a transmission axis (polarization axis) and a reflection axis which are perpendicular to each other and thus has characteristics to transmit linearly polarized light whose polarization direction is parallel to the transmission axis and reflect linearly polarized light whose polarization direction is parallel to the reflection axis. Alternatively, the reflector 46 may be a transflective reflector disposed inside the second polarizing film 41*b*.

A concrete driving method of the liquid crystal panel with a memory effect 40 when a ferroelectric liquid crystal is used for the liquid crystal layer having a memory effect 42 will be described now using FIG. 3 and FIG. 5 to FIG. 9.

In FIG. 3, (a) shows the waveform of the scanning voltage applied to a scanning electrode TP1 in FIG. 5, (b) similarly shows the waveform of the scanning voltage applied to a scanning electrode TP2, and (c) and (d) show the waveforms of the signal voltages applied to signal electrodes SG1 and SG2 in FIG. 5.

Further, (e) is the driving voltage waveform applied to a pixel Pix (1, 1) in FIG. 5, that is, the voltage waveform (TP1-SG1) applied between the scanning electrode TP1 and the signal electrode SG1, which is the waveform of a composite voltage of the voltage waveform of the scanning voltage applied to the scanning electrode TP1 and the voltage waveform of the signal voltage applied to the signal electrode SG1.

Further, (f) is the driving voltage waveform applied to a pixel Pix (1, 2) in FIG. 5, that is, the voltage waveform (TP1-SG2) applied between the scanning electrode TP1 and the signal electrode SG2, which is the waveform of a composite voltage of the voltage waveform of the scanning voltage applied to the scanning electrode TP1 and the voltage waveform of the signal voltage applied to the signal electrode SG2.

Further, (g) is the transmittance waveform at the pixel Pix (1, 1) in FIG. 5, and (h) is the transmittance waveform at the pixel Pix (1, 2) in FIG. 5.

Note that transmittance waveforms in (g) and (h) are waveforms of the transmittances of light detected by a photo detector or the like when the driving voltages in the composite voltage waveforms shown in (e) and (f) are applied between the scanning electrode and the signal electrodes forming the pixels Pix (1, 1) and Pix (1, 2) of the ferroelectric liquid crystal panel, respectively.

The image data displayed at each pixel is displayed in a plurality of scanning periods. The plural scanning periods are composed of a frame F2 being a selection period for applying a selection pulse SP between the scanning electrode and the signal electrode in order to cause the pixel to display, a frame F1 being a reset period for applying a reset pulse RP between the above-described electrodes in order to reset the state of the pixel placed before the frame F2, and a frame F0 being a correction period for applying a correction pulse CP in order to correct the alternation placed before the frame F1.

In short, the image data displayed at the pixel is displayed in the three scanning periods so that the display contents of the liquid crystal panel with a memory effect 40 are rewritten in this embodiment. Note that one scanning period is a period for scanning the entire screen of the liquid crystal panel with a memory effect one time, that is the period in which voltage apply all scanning electrodes, namely, from the first scanning electrode to the last scanning electrode.

The voltage waveform of the scanning voltage TPV and the voltage waveform of the signal voltage SGV outputted from the driving circuit 30 shown in FIG. 1 are applied the scanning electrode and the signal electrode respectively. (e) and (f) of FIG. 3 show the waveforms of the composite voltage.

In this embodiment, the liquid crystal having a memory effect at the pixel is brought to a second stable state (OFF) that is one of bistable states described with FIG. 6 in the frame F1 being the reset period, and the liquid crystal having a memory effect is brought to a first stable state (ON) that is the other stable state in the frame F0 being the correction period. Further, the liquid crystal having a memory effect is brought to the first stable state (ON) or the second stable state (OFF) according to the image data and then the selected stable state is held as it is in the frame F2 being the selection period.

Therefore, the waveform of the above-described composite voltage has the reset pulse RP in the reset period (frame F1), has the selection pulse SP in the selection period (frame F2), and has the correction pulse CP in the correction period (frame F0).

Further, as shown in FIG. 3, the reset pulse RP is composed of the voltage waveform applied to the signal electrodes SG1, SG2, . . . with voltage applied to the scanning electrodes TP1, TP2, . . . being 0V. The selection pulses SPw, SPb is composed of the voltage waveform applied to the signal electrodes SG1, SG2, . . . and the voltage waveform applied to the scanning electrodes TP1, TP2 . . . . Further, the correction pulses CP1, CP2, . . . is mainly composed of the voltage waveform applied to the scanning electrodes TP1, TP2, . . . .

In any of the above-described correction period (frame F0), the reset period (frame F1), and the selection period (frame F2), the reference potential of the scanning voltage and the signal voltage outputted from the driving circuit 30 shown in FIG. 1 is 0V at all times.

Here, concrete examples of the waveforms of each of the each scanning voltages to be applied respectively to the scanning electrodes TP1 and TP2 and each of the signal voltages to be applied respectively to the signal electrodes SG1 and SG2 shown in FIG. 5 of the liquid crystal panel with a memory effect 40 will be described.

As described above, the reference potentials of the scanning voltage and the signal voltage are 0V at all times, and all of the voltage values VS, VD and VH are of the same polarity and their absolute values are such that VD=½*VS (=¾*VS) and VH=¼*VS.

The example of driving a liquid crystal panel with a memory effect having 160 signal electrodes and 128 scanning electrodes forming 160×128=20480 pixels will be described.

First, the driving waveform in the frame F0 that is the correction period will be described. As shown in (a) and (b) of FIG. 3, two pulses at the voltage value VD and at the voltage value VS are sequentially applied to the scanning electrode TP1 and the scanning electrode TP2 in the frame F0. In this manner, the two pulses are applied sequentially to all of the scanning electrodes.

Further, in the frame F0, the pulse at the voltage value VH is applied to the signal electrode SG1 and the signal electrode SG2 as shown in (c) and (d) of FIG. 3. As will be appreciated from the drawing, actually, two pulses at the voltage value VH and the voltage value 0V are applied sequentially to all of the signal electrodes.

Therefore, because the number of signal electrodes is larger than the number of the scanning electrodes in this embodiment, the length of period of the frame F0 that is the correction period corresponds to that obtained by multiplying (the time period of two pulses) by (the number of signal electrodes).

Next, the pulses will be described in detail.

At first, the correction period (frame F0) shown in FIG. 3 will be described. The scanning voltage waveform to be applied to the scanning electrode TP1 is shown in (a) of FIG. 3. Therefor, aforementioned row driver IC outputs first successively the two pulses at the voltage value VD and at the voltage value VS, and during the subsequent remaining period, outputs the voltage value 0V.

The scanning voltage waveform to be applied to the next scanning electrode TP2 is shown in (b) of FIG. 3. The row driver IC outputs the voltage value 0V during the period corresponding to the first two pulses, and then successively outputs the two pulses at the voltage value VD and at the voltage value VS for correction. During the subsequent remaining period of the period, the row drive IC outputs the voltage value 0V.

In this manner, each of the scanning voltage waveforms for the 128 scanning electrodes are made by the row driver IC. Therefor, the row driver IC successively outputs the pulse at the voltage value VD and the pulse at the voltage value VS each of them being positive polarity as the pulse voltage for correction in order from the first scanning electrode.

In this manner, each of the two pulses are sequentially applied to the first to the 128th scanning electrodes at a timing with a delay. Thus, the correction pulse voltage composed of the pulse at the voltage value VD and the pulse at the voltage value VS is applied sequentially to the scanning electrodes.

On the other hand, the signal voltage waveform to be applied to the signal electrode SG1 is shown in (c) of FIG. 3. Therefor, aforementioned column driver IC outputs a pulse at the voltage value VH for correction in the first half of the two pulses applied to the scanning electrode, and outputs thereafter the voltage value 0V during the remaining period of the frame.

The signal voltage waveform to be applied to the next signal electrode SG2 is shown in (d) of FIG. 3. The column driver IC outputs the voltage value 0V during the period corresponding to the two pulses, and outputs a pulse at the voltage value VH for correction in the first half of next two pulses, and outputs thereafter the voltage value 0V during the remaining period of the frame.

The similarly generated signal voltage waveforms each composed of a correction pulse voltage at the voltage value VH are sequentially applied to the 160 signal electrodes at a timing with a delay of a period corresponding to two pulses.

Accordingly, assuming that the pixel Pix (1, 1) shown in FIG. 5 of the liquid crystal panel with a memory effect 40 is the first pixel on the first scanning electrode, the waveform shown in (e) of FIG. 3 that is the composite voltage waveform of the scanning voltage waveform shown in (a) of FIG. 3 and the signal voltage waveform shown in (c) of FIG. 3 is applied between the scanning electrode TP1 and the signal electrode SG1 at a portion forming the pixel.

The correction pulse CP1 during the correcting period (frame F0) is a pulse at a difference voltage value of VD−VH=+VH at a timing of the first half of the two pulses because the scanning voltage is at VD and the signal voltage is at VH, and is a pulse at a difference voltage value of VS−0=+VS at a timing of the second half because the scanning voltage TP1 is at VS and the signal voltage is at 0V.

Since the pixel Pix (1, 2) shown in FIG. 5 is a pixel on the same scanning electrode as the pixel Pix (1, 1), the voltage in the composite voltage waveform of the scanning voltage waveform shown in (a) of FIG. 3 and the signal voltage waveform shown in (d) of FIG. 3, that is, the voltage having waveform shown in (f) of FIG. 3 is applied between the scanning electrode TP1 and the signal electrode SG2 at a portion forming the pixel, in which the correction pulse CP2 is applied in the correction period (frame F0).

The composite voltage value applied to the pixel Pix (1, 2) is a pulse at VD−0=+VD as shown in the composite voltage waveform in (f) of FIG. 3 in the first half of the first two pulses of the correction pulse CP2 because the voltage value applied to the scanning electrode TP1 is VD as shown in FIG. 3(*a*) and the voltage value applied to the signal electrode SG2 is 0V as shown in FIG. 3(*d*), and the composite voltage value applied to the pixel Pix (1, 2) is a pulse at VS−0=+VS as shown in (f) of FIG. 3 in the second half of the correction pulse CP because the voltage value applied to the scanning electrode TP1 is VS and the voltage value applied to the signal voltage SG2 is 0V.

Further, the correction pulse CP2 is a pulse at (0−VH)=−VH as shown in (f) of FIG. 3 in the first half of the next two pulses because the voltage value applied to the scanning electrode TP1 is 0V and the voltage value applied to the signal electrode SG2 is VH.

As described above, the correction pulse CP2 is composed of the two positive pulses at the voltage values +VD and +VS and one negative pulse at the voltage value −VH in which a half of the voltage of the positive pulse at +VD is offset by the negative pulse at −VH to be equivalent to the positive pulse at +VH. Therefore, the correction pulse CP2 is equivalent to the correction pulse CP1 composed of the two positive pulses at the voltage values +VH and +VS.

On the second scanning electrode, the correction pulse CP1 is applied only at the second pixel, whereas the correction pulse CP2 or a correction pulse at a sequentially delayed timing of generating the pulse at the voltage value −VH is applied at other pixels. Also on the third to the 128th scanning electrodes, the correction pulse CP2 is applied to each of the pixels while the pixel is merely sequentially shifted from one to another. Accordingly, the correction pulse CP1 or the correction pulse CP2 substantially equivalent to it or the like is applied at all of the pixels in the frame F0.

Though the correction function will be described later, each of the correction pulses CP1, CP2 and so on has the pulse at the voltage value +VS larger than the threshold value +Vt at which the stable state of the liquid crystal having a memory effect described with FIG. 6 varies. Therefore, those correction pulses also has a prereset function of bringing all of the pixels to a white (ON) state as shown in (g) and (h) of FIG. 3.

Figure 7:
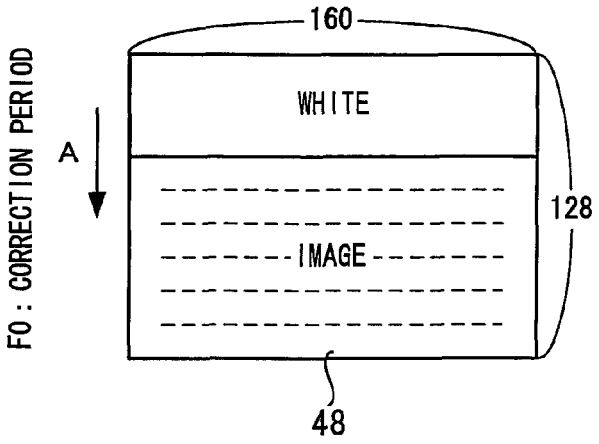
FIG. 7 is an explanatory view showing a change on a screen of the liquid crystal panel with a memory effect in a correction period of the liquid crystal display device according to the invention.

Accordingly, as shown in FIG. 7, a screen 48 of the liquid crystal panel with a memory effect is prereset from the image display state into the white (ON) image state in a direction of an arrow A from the first scanning electrode to the 128th scanning electrode in the frame F0.

Next, the frame F1 that is the reset period shown in FIG. 3 will be described. In this frame F1, the voltage waveforms to be applied to the scanning electrodes TP1 and TP2 shown in (a) and (b) of FIG. 3 and also to be applied to all of the scanning electrodes TP1 to TP 128 are kept at voltage value 0V during the frame period.

Further, as shown in (c) and (d) of FIG. 3, two pulses at the voltage value VS are applied to the signal electrode SG1 and the signal electrode SG2 in the frame F1. The two pulses are applied sequentially to all of the signal electrodes.

Therefore, because the number of the signal electrodes is larger than the number of the scanning electrodes in this embodiment, the length of period of the frame F1 that is the reset period corresponds to that obtained by multiplying (the time period of two pulses) by (the number of signal electrodes). Accordingly, the frame F1 is the same in length as the above-described frame F0.

Next, the pulses will be described in detail. As the waveform to be applied to the signal electrode SG1 shown in (c) of FIG. 3 first the two pulses at the voltage value VS successively outputted and is at the voltage value 0V during the subsequent remaining frame.

The waveform to be applied to the next signal electrode SG2 shown in (d) of FIG. 3 is at the voltage value 0V during the period corresponding to the first two pulses, and then appears successively two pulses at the voltage value VS and is at the voltage value 0V during the subsequent remaining frame. In this manner, two successive pulses at the voltage value VS as the resetting pulse voltage are applied successively to each the signal electrodes SG1 to SG160 while shifting by two pulses.

Since the pixel Pix (1, 1) and the pixel Pix (1, 2) shown in FIG. 5 of the liquid crystal panel with a memory effect 40 are assumed the first pixel and the second pixel on the first scanning electrode.

The composite voltage of the scanning voltage waveform shown in (a) of FIG. 3 and the signal voltage waveform shown in (c) of FIG. 3 or the signal waveform shown in (d) of FIG. 3, that is, the reset pulses RP in the composite voltage waveform of shown in (e) of FIG. or in the composite voltage waveform shown in (f) of FIG is applied sequentially between the scanning electrode TP1 and the signal electrode SG1, SG2 at a portion forming each of the pixels. Any of the reset pulses RP is successive two pulses at the voltage value of 0−VS=−VS.

In this manner, the reset pulses RP are simultaneously applied to 128 pixels in one column along the signal electrode SG1 in FIG. 5, and thereafter the reset pulses RP are sequentially applied also to 128 pixels in each of the columns along the signal electrodes SG2 to SG 160.

Any of the reset pulses RP is composed of the successive two pulses at the voltage value −VS larger in absolute value than the threshold value −Vt at which the stable state of the liquid crystal having a memory effect described with FIG. 6 varies and therefore serves as the reset function of bringing all of the pixels to a black (OFF) state as transmittance curves shown in (g) and (h) of FIG. 3.

Figure 8:
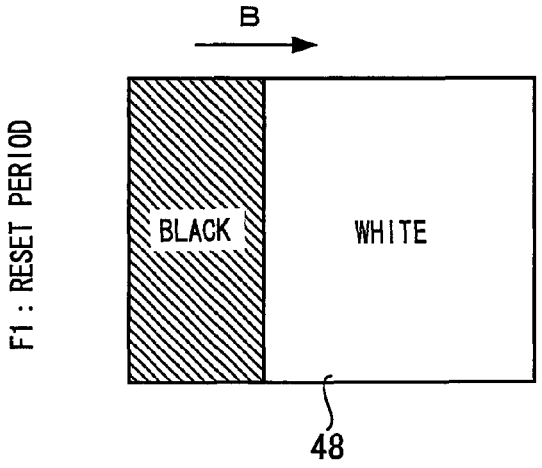
FIG. 8 is an explanatory view showing a change on the screen of the liquid crystal panel with a memory effect in a reset period of the same.

Accordingly, in the frame F1, the whole screen 48 in FIG. 7 of the liquid crystal panel with a memory effect is reset from the prereset state in the white (ON) image to the black (OFF) image state in a direction of an arrow B from the first signal electrode to the 160th signal electrode as shown in FIG. 8.

The reset pulse RP is a double pulse at the voltage value −VS as described above, and has an actual pulse width at least twice a later-described selection pulse SP.

In this example, to make all of the pulse widths of the pulse signals to be outputted from the driving circuit (driver IC) the same, two pulses each having the same pulse width as that of the selection pulse SP are successively formed as the reset pulse RP. In this manner, it is made possible to surely perform reset and to also perform reset liquid crystal molecules between the pixels by applying sufficient large voltage.

Further, in the frame F0 and the frame F1, the driving method of sequentially applying pulses similarly to the scanning electrode and the signal electrode is employed, thus eliminating the driving current to the electrodes by driver ICs at the same time, leading to a decrease in size of the transistor in the driver ICs.

Further, since the signal electrode driving circuit and the scanning electrode driving circuit can be controlled by the equivalent system, the driving circuits for them can be composed of the same circuit, leading to easier design.

Next, the frame F2 that is the selection period shown in FIG. 3 will be described. In this frame F2, as the voltage waveform to be applied to the scanning electrode TP1 shown in (a) of FIG. 3 first two pulses at the voltage value VH and at the voltage value VS successively outputted as a selecting pulse. Thereafter, the pulse at the voltage value VH is sequentially outputted.

As the voltage waveform to be applied to the next scanning electrode TP2 shown in (b) of FIG. 3 first two pulses at the voltage value VH successively outputted and then two pulses at the voltage value VH and at the voltage value VS successively outputted as a selecting pulse. Thereafter, the pulse at the voltage value VH is outputted.

In this manner, each of the scanning electrodes TP1 to TP128 for the 128 scanning electrodes are successively applied the pulse at the voltage value VH and the pulse at the voltage value VS as the selecting pulse in order from the first scanning electrode at a timing with a delay corresponding to two pulses. At the other all timings, each of the scanning electrodes are applied a pulse at the voltage value VH.

The scanning voltages waveform are sequentially applied to the first to the 128th scanning electrodes.

On the other hand, as the voltage waveform to be applied to each of the signal electrodes SG1 and SG2 shown in (c) and (d) of FIG. 3, at a timing corresponding to two pulses, according to the image data a pulse at the voltage value VD in the first half of a period corresponding to the two pulses are outputted and brings the voltage value to 0V in the second half of a period corresponding to the two pulses for the white image (ON).

The voltage waveform brings the voltage value to 0V according to the image data in the first half and a pulse at the voltage value VD outputted in the second half for the black image (OFF). This also applies to the not-shown signal electrodes SG3 to SG160. The signal voltages waveform are simultaneously applied to the 160 signal electrodes in a parallel manner.

The voltage waveform to be applied to the signal voltage SG1 shown in (c) of FIG. 3 shows an example of a selecting pulse voltage for causing the pixels on the first column to sequentially display white, black, black, white, black and so on from the first pixel. The voltage waveform to be applied to the signal voltage SG2 shown in (d) of FIG. 3 shows an example of a selecting pulse voltage for causing the pixels on the second column to sequentially display black, black, black, white, black and so on from the first pixel.

Accordingly, when the selecting pulse composed of the pulse at the voltage value VH and the pulse at the voltage value VS is applied to the scanning electrode as the scanning voltage, the selection pulse SPw composed of the pulse at the voltage value −VH and the pulse at the voltage value +VS subsequent thereto as shown in (e) of FIG. 3 is applied to the pixel signal voltage at the voltage value VD.

Further, the selection pulse SPb composed of the pulse at the voltage value +VH and the pulse at the voltage value +VD subsequent thereto as shown in (f) of FIG. 3 is applied to the pixel at which the signal voltage at the voltage value VD is applied to the signal electrode after the signal voltage at the voltage value 0V.

For example, when the pixel Pix (1, 1) and the pixel Pix (1, 2) shown in FIG. 5 are assumed the first pixel and the second pixel on the first scanning electrode, the composite voltage waveform of the scanning voltage waveform shown in (a) of FIG. 3 and the signal voltage waveform shown in (c) of FIG. 3 or the signal voltage waveform shown in (d) of FIG. 3 that is the voltage having the waveform shown (e) or (f) of FIG. 3 is applied between the scanning electrode TP1 and the signal electrode SG1, SG2 at a portion forming each of the pixels, thus each of the selection pulses SPw and SPb is respectively applied during the frame F2

In other words, the length of period of the frame F2 corresponds to that obtained by multiplying (the time period of two pulses) by (the number of scanning electrodes). Accordingly, the length of period of the frame F2 is shorter than those of the above-described frame F0 and frame F1.

The selection pulse SPw has a pulse at the voltage value +VS larger than the threshold value +Vt at which the stable state of the liquid crystal having a memory effect described with FIG. 6 varies and therefore brings the pixel which has been reset to the black (OFF) state, to the white (ON) state as shown in (g) of FIG. 3.

On the other hand, the selection pulse SPb merely has pulses at the voltage value +VH and at the voltage value +VD each smaller than the threshold value +Vt at which the stable state of the liquid crystal having a threshold value +Vt at which the stable state of the liquid crystal having a memory effect described with FIG. 6 varies and therefore holds the pixel which has been reset to the black (OFF) state, as it is as shown in (h) of FIG. 3, thereby keeping the black (OFF) state.

Figure 9:
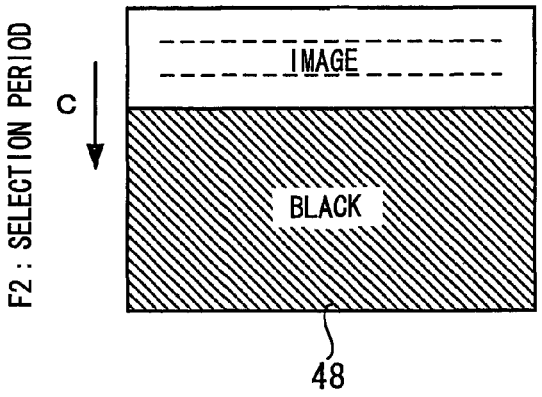
FIG. 9 is an explanatory view showing a change on the screen of the liquid crystal panel with a memory effect in a selection period of the same.

Accordingly, in the frame F2, the whole screen 48 of the liquid crystal panel with a memory effect is rewritten from the reset state in the black (OFF) image to the image display state in white (ON) or black (OFF) in a direction of an arrow C from the first row to the 128th row as shown in FIG. 9.

As described above, any color (white or black) can be displayed at any pixel by combining the pulse voltage to be applied to the scanning electrode and the pulse voltage to be applied to the signal electrode in the selection period. Further, because a large level difference between the selection pulses SPw and SPb of VS/2 is set, image selection can be surely performed even if the state changing characteristics of the liquid crystal are not steep because of a large margin between white and black.

Figure 10:
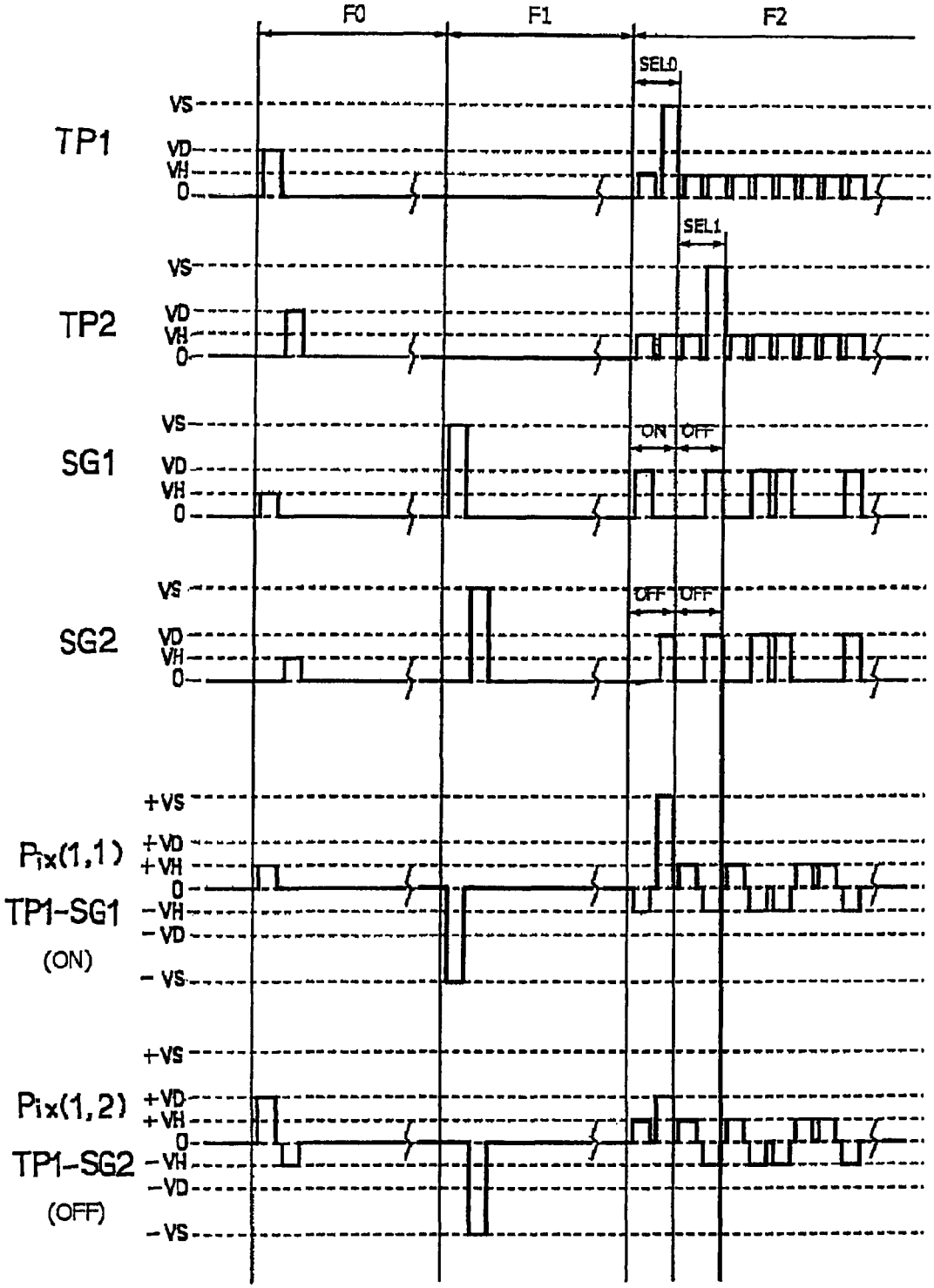
FIG. 10 is a waveform chart showing an example of a driving voltage waveform, changed a part of the driving voltage waveform shown in FIG. 3.
Figure 11:
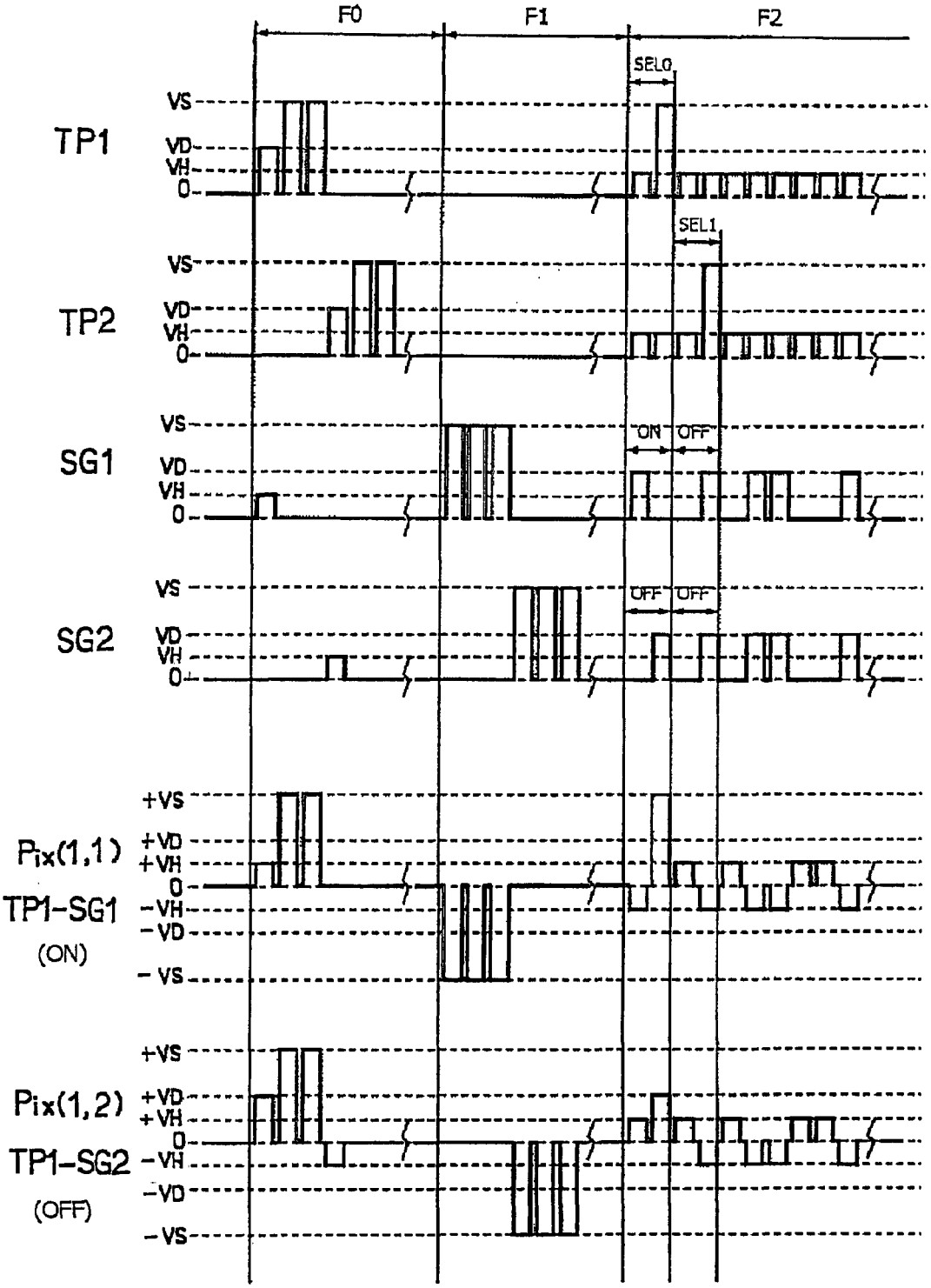
FIG. 11 is a waveform chart showing another example of a driving voltage waveform, changed a part of the driving voltage waveform shown in FIG. 3.

Note that three frames are required to rewrite the image on the screen 48 of the liquid crystal panel with a memory effect 40 when the image data are changed, but there is no problem because the liquid crystal panel with a memory effect can maintain the display state and frequency of rewriting is low Though the reset pulse in the reset period (frame F1) is composed of two successive pulses in the above-described embodiment, the similar effects can be expected even if the reset pulse is composed of one pulse as in the example shown in FIG. 10 or is changed to be composed of three pulses as in the example shown in FIG. 11.

Note that when the reset pulse is composed of one pulse, the pulse when the reset pulse is composed of three pulses, the pulse of the voltage value VS in the frame F0 is changed to be two successive pulses.

In these embodiments, the driving circuit shown in FIG. 1 consistently applies a scanning voltage in a voltage waveform composed of a voltage value 0V and positive unipolar voltage values to the scanning electrodes TP1 to TP128 of the liquid crystal panel with a memory effect 40 across a plural scanning periods F0, F1 and F2, and also a signal voltage in a voltage waveform composed of a voltage value 0V and unipolar voltage values having the same polarity as the polarity of the scanning voltage to the signal electrodes SG1 to SG160 across the plural scanning periods F0, F1 and F2.

Then, the image data displayed at each pixel is displayed during the plural scanning periods F0, F1 and F2, and the composite voltage applied between the scanning electrode and the signal electrode at a portion forming each pixel is made alternating in the plural scanning periods.

Each of the voltage waveforms of the scanning voltage and the signal voltage may be composed of a voltage value 0V and negative unipolar voltage values. Namely, it is only necessary that the voltage waveforms of the scanning voltage and the signal voltage are composed of a voltage value 0V and voltage values which are either positive or negative unipolar and have the same polarity.

Incidentally, in the three frames from the frame F0 to the frame F2 of FIG. 3, the voltage to be applied between the electrodes at a portion corresponding to the pixel Pix (1, 1) shown in (e) of FIG. 3 has a waveform such that the pulse at the voltage value +VS in the second half of the correction pulse CP1 and the pulse at the voltage value +VS in the second half of the selection pulse SPw are equivalent in positive and negative half of the selection pulse SPw are equivalent in positive and negative polarity to the reset pulse composed of two pulses at the voltage value −VS. Further, the pulse at the voltage value +VH in the first half of the correction pulse CP1 is equivalent in positive and negative polarity to the pulse at the voltage value −VH in the first half of the selection pulse SPw, and the waveform after the selection pulse SPw is equal in positive and negative. Therefore, the voltage is made completely alternating, thus leaving no DC component.

Similarly, in the three frames from the frame F0 to the frame F2 of FIG. 3, the voltage to be applied between the electrodes at a portion corresponding to the pixel Pix (1, 2) shown in (f) also has a waveform such that the first pulse at the voltage value VD and the second pulse at the voltage value +VS of the correction pulse CP2 and the pulse at the voltage value +VD in the second half of the selection pulse SPb are equivalent in positive and negative polarity to the reset pulse composed of two pulses at the voltage value −VS. Further, the third pulse at the voltage value −VH of the correction pulse CP2 is equivalent in positive and negative polarity to the pulse at the voltage value +VH in the first half of the selection pulse SPb, and the waveform after the selection pulse SPb is equal in positive and negative. Therefore, the voltage is made completely alternating, thus leaving no DC component.

Every voltage to be applied between the electrodes at a portion corresponding to another pixel similarly has a waveform such that the positive voltage component is equal to the negative voltage component among the three frames from the frames F0 to F2, and is therefore made completely alternating.

As described above, correction can be performed so that the positive voltage component is equal to the negative voltage component among the three frames from the frame F0 to the frame F2 irrespective of combination of the correction pulses CP1 and CP2 having different waveforms (generically referring to the one different in time of generating the third negative pulse) and the selection pulses SPw and SPb having different waveforms.

More specifically, correction can be performed to completely make the voltage waveform to be applied between the electrodes alternating waveform by the correction pulse CP1 or CP2 whether the subsequent image at the pixel is white or black. Further, any correcting voltage is not applied nor the reference voltage is not changed after the display state at the pixel is selected, so that the display quality is not deteriorated and an in crease in the display quality can be realized. Same effects are obtained in the case of the examples shown in FIG. 10 or FIG. 11.

Further, the scanning voltage and the signal voltage in the voltage waveforms generating the above-described pulses are applied to the scanning electrodes and the signal electrodes of the liquid crystal panel with a memory effect respectively line by line in the above-described correction period, reset period and selection period.

Here, concrete examples of the signal electrode driving circuit (column driver IC) 31 outputting the signal voltage and the scanning electrode driving circuit (row driver IC) 32 outputting the scanning voltage which are described above will be described using FIG. 4. The signal electrode driving circuit 31 and the scanning electrode driving circuit 32 are driver ICs having the same configuration and are compatible with each other. Therefore, FIG. 4 is used for both the signal electrode driving circuit 31 and the scanning electrode driving circuit 32.

Each of the driving circuits is composed of a driving voltage waveform control circuit 35 and analog switches AS1 to ASn each forming a selector circuit. Assuming that the number of signal electrodes 44*b* or scanning electrodes 44*a* of the liquid crystal panel with a memory effect 40 shown in FIG. 2 is n, the analog switches AS1 to ASn corresponding to the number n are provided.

The voltages at voltage values 0V, VH, VD and VS outputted from the driving voltage generation circuit 10 shown in FIG. 1 are applied to each of the analog switches AS1 to ASn. Then, each of the analog switches AS1 to ASn is controlled by the signal side control signal CSa or the scan side control signal CSb from the control signal generation circuit 20 shown in FIG. 1 to sequentially select a necessary voltage according to each select signal outputted from the driving voltage waveform control circuit 35 to output the signal voltage to be applied to each of the signal electrodes 44*b* or the scanning voltage to be applied to each of the scanning electrodes 44*a* shown in FIG. 2 as each of OUT0 to OUTn.

According to this embodiment, each of the voltage waveforms of the scanning voltage and the signal voltage outputted from the driving circuit 30 to drive the liquid crystal panel with a memory effect 40 can be positive or negative unipolarity, the level values of the voltages forming each of the voltage waveforms, that is, the kinds of the voltage values can be four values (0V, VH, VD and VS) even including both the scanning voltage and the signal voltage, and each of the voltage waveforms can be made simple as shown in FIG. 3.

Accordingly, the driver ICs of the scanning electrode driving circuit 32 and the signal electrode driving circuit 31 can be reduced in size and manufactured at low cost. This allows a liquid crystal display device provided with the liquid crystal panel with a memory effect 40 to be provided at low cost.

In addition, the scanning electrode driving circuit 32 and the signal electrode driving circuit 31 can be configured the same to have compatibility with each other so that one can be used for both of them. Because all of the waveforms for pulses have the same polarity, a boosting circuit generating the voltages can be easily manufactured and the power consumption of the whole system can also be reduced.

Figure 12:
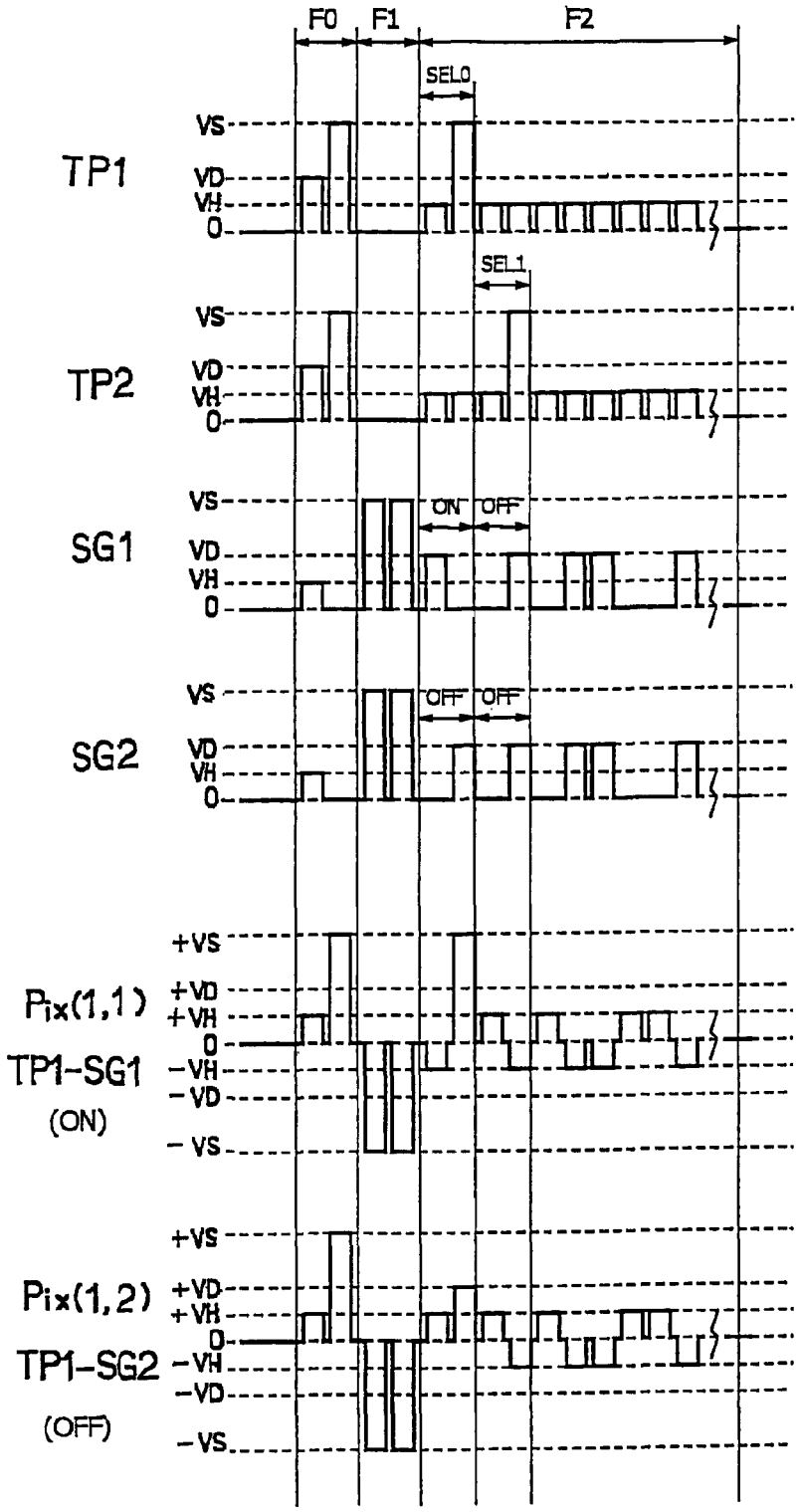
FIG. 12 is a waveform chart showing the driving voltage waveform to be applied to a liquid crystal panel with a memory effect in another embodiment of the invention.

Next, another embodiment of the invention will be described using FIG. 12. FIG. 12 is a waveform chart, similar to FIG. 3, showing the driving voltage waveform to be applied to the liquid crystal panel with a memory effect.

In this embodiment, the correction pulses CP are simultaneously applied between all of the scanning electrodes and the signal electrodes (see FIG. 5) in the correction period (frame F0), and the reset pulses RP are simultaneously applied between all of the scanning electrodes and the signal electrodes in the reset period (frame F1). This can significantly reduce the time required for preresetting and resetting the screen display and reduce the time for updating the screen. Details thereof will be described below.

Two successive pulses at the voltage value VD (=¾*VS) and the voltage value VS are simultaneously applied to the scanning electrodes TP1 and TP2 in the frame F0 being the correction period shown in FIG. 12. In short, the scanning voltages each composed of the two successive pulses are simultaneously applied to all of the 128 scanning electrodes.

Further, in the frame F0, the pulses at the voltage value VH (=¼*VS) and the voltage values 0V are simultaneously outputted to the signal electrodes SG1 and SG2. In short, the signal voltages each composed of the pulse at the voltage value VH and the voltage value 0V are simultaneously applied to all of the 160 signal electrodes.

Accordingly, the correction pulses CP each composed of two pulses at +VD−VH=+VH and at +VS−0=+VS which are the composite voltage of the scanning voltage and the signal voltage are applied between the scanning electrodes and the signal electrodes at all pixels of the liquid crystal panel with a memory effect. Because the voltage value +VS in the second half of the correction pulse CP is larger than the threshold value +Vt at which the stable state of the liquid crystal having a memory effect changes, the screen display is instantaneously prereset to the white (ON) image state in the frame F0.

In this frame F1 being the reset period shown in FIG. 12, each of the voltage values to the scanning electrodes TP1 and TP2 is brought to 0V In short, the scanning voltages at the voltage value 0V are simultaneously applied to all of the 128 scanning electrodes.

Further, aforementiond column driver IC outputs two successive pulses at the voltage value VS simultaneously to the signal electrodes SG1 and SG2 in the frame F1. In short, the signal voltages each composed of the two successive pulses are simultaneously applied to all of the 160 signal electrodes.

Accordingly, the reset pulses RP each composed of two successive pulses at 0−VS=−VS that is the composite voltage of the scanning voltage and the signal voltage are simultaneously applied between the scanning electrodes and the signal electrodes at all of the pixels of the liquid crystal panel with a memory effect. Because the voltage value −VS of the reset pulse RP is smaller (larger in absolute value) than the threshold value −Vt at which the stable state of the liquid crystal having a memory effect changes, the screen display is instantaneously reset to the black (OFF) image state in the frame F1.

The rewriting of the screen is performed line by line of the scanning electrodes or the signal electrodes, and therefore the screen is sequentially brought to the black image after the white image as described with FIG. 7 and FIG. 8 in the above-described embodiment. However, the correction pulses and the reset pulses are simultaneously applied to the electrodes at all of the pixels in this embodiment, so that the whole screen is instantaneously brought to the white image by prereset and is instantaneously brought to the black image by reset.

The operations of applying the scanning voltage and the signal voltage to each of the scanning electrodes and the signal electrodes in the frame F2 being the selection period and applying the selection pulse SPw or SPb between the electrodes at each pixel and so on are the same as those in the above-described embodiment described with FIG. 3.

Even when more number of scanning electrodes and signal electrodes are provided, voltages can be simultaneously applied to all of the scanning electrodes and all of the signal electrodes in the correction period and the reset period by the above-described method. Therefore, the correction period (frame F0) and the reset period (frame F1) can be shortened, so that the time consumed for updating the screen can be significantly reduced.

Further, in driving at room temperatures, the time width of each of the frame F0 and of the frame F1 is about 3 msec so that the switching between the white image by prereset and the black image by reset is instantaneous, resulting in improved display quality. Further, the voltage applied between the scanning electrode and the signal electrode is made alternating as a matter of course as in the above-described embodiment.

Figure 13:
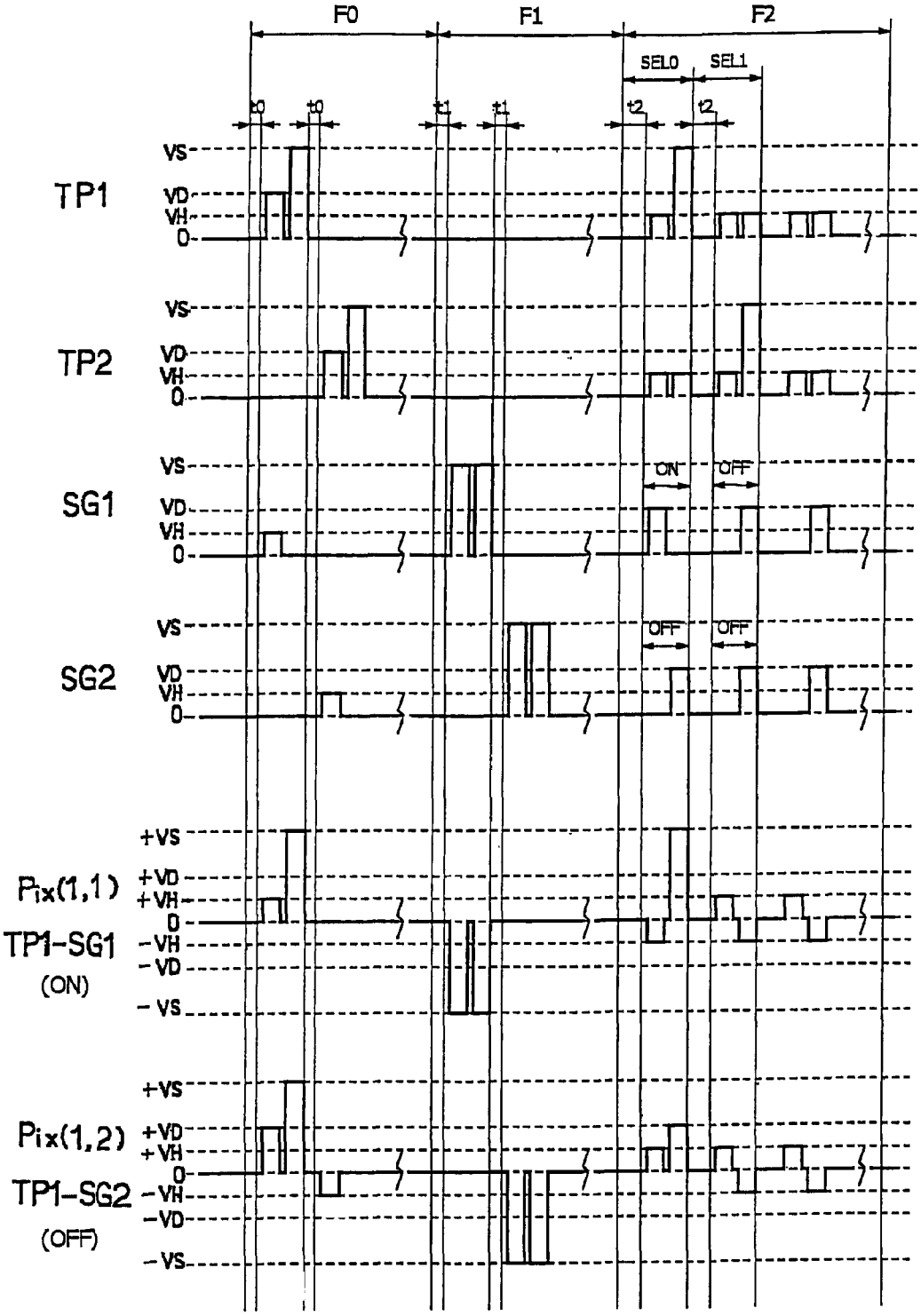
FIG. 13 is a waveform chart showing the driving voltage waveform to be applied to a liquid crystal panel with a memory effect in still another embodiment of the invention.
Figure 14:
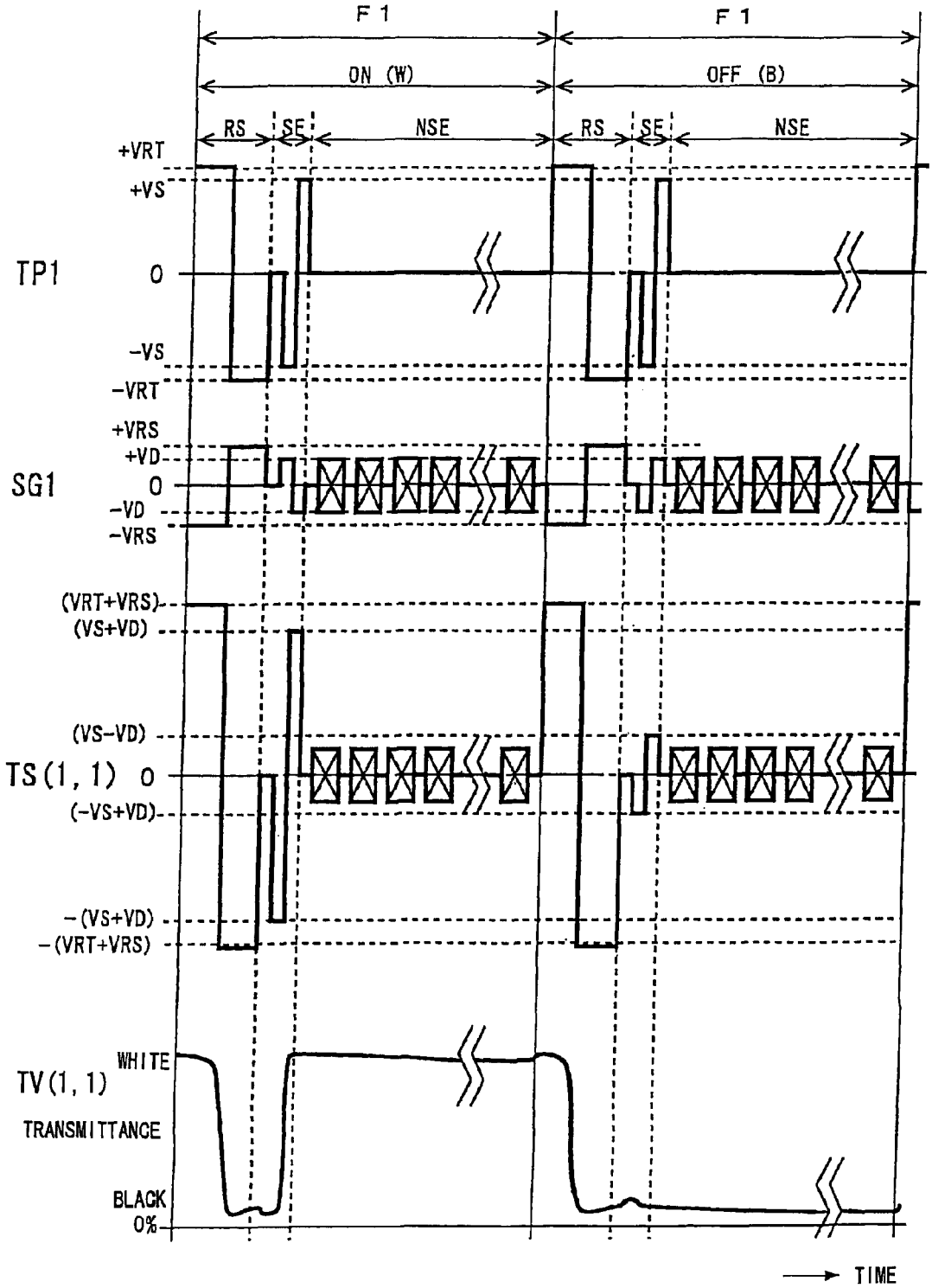
FIG. 14 RELATED ART
FIG. 14 is a waveform chart showing the relation between the driving voltage waveform to be applied to a liquid crystal panel with a memory effect and the transmittance in a conventional liquid crystal display device.
Figure 15:
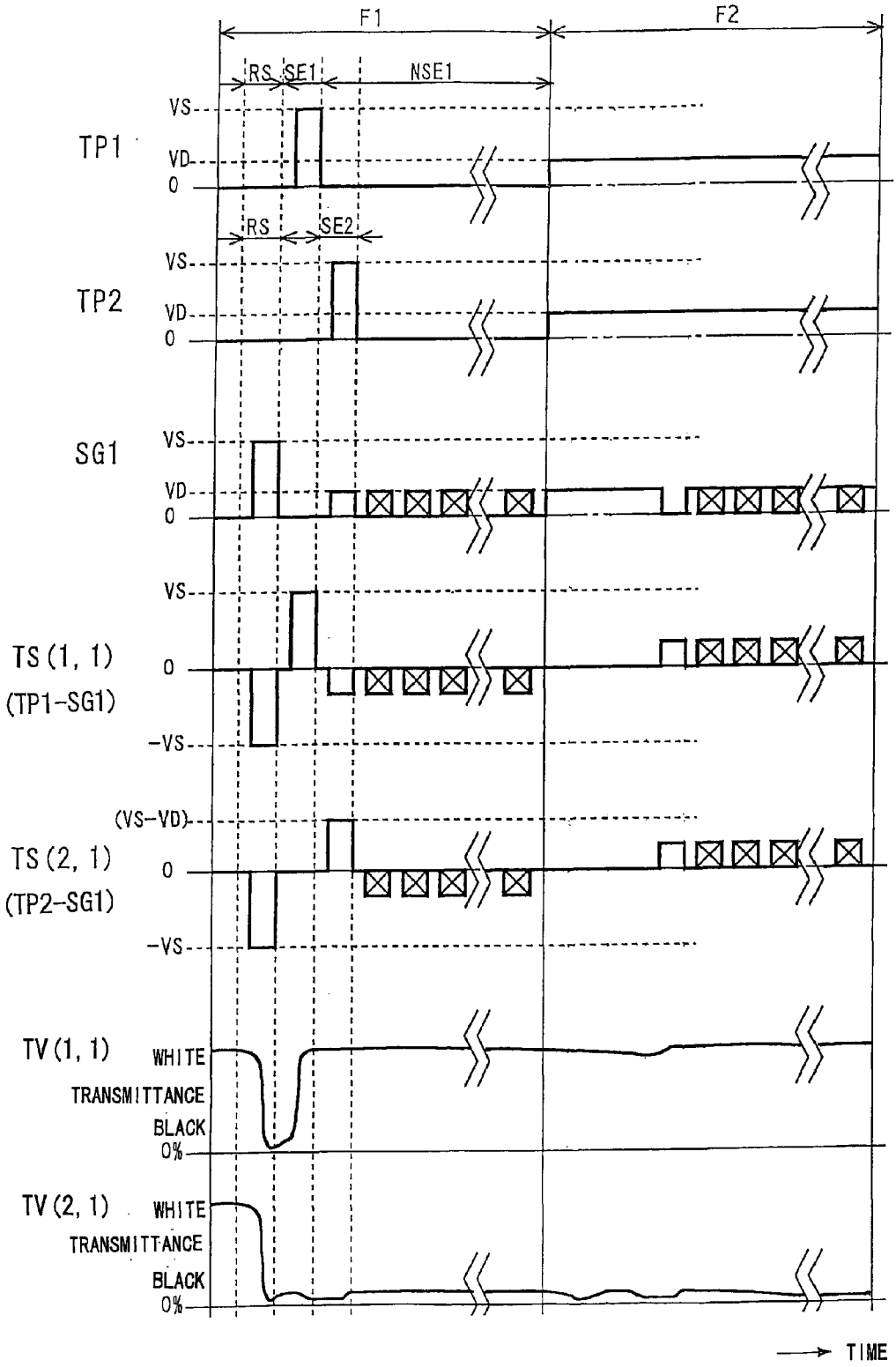
FIG. 15 RELATED ART
FIG. 15 is a waveform chart showing the relation between the driving voltage waveform to be applied to a liquid crystal panel with a memory effect and the transmittance in a previously invented liquid crystal display device.

Next, still another embodiment of the invention will be described using FIG. 13. FIG. 13 is a voltage waveform chart, similar to FIG. 3, showing the driving voltage waveform to be applied to the liquid crystal panel with a memory effect in that case.

In this embodiment, in the frame F2 being the selection period, the scanning voltage and the signal voltage in the voltage waveforms generating the selection pulse are applied sequentially to the scanning electrodes and the signal electrodes respectively line by line as in the above-described embodiments. However, a pause period t2 during which a voltage value 0V is applied to both of the scanning electrode and the signal electrode is provided between the voltage application periods.

The operations in the frame F0 being the correction period and the frame F1 being the reset period shown in FIG. 13 are almost the same as those in the embodiment described with FIG. 3. However, a pause period t0 is provided between the correction pulses to the scanning electrodes in the frame F0.

Further, a pause period t1 is provided between the reset pulses to the signal electrodes in the frame F1. However, the pause period t0 and the pause period t1 may be omitted.

In the frame F2 being the selection period, two successive pulses at the voltage value VH (=¼*VS) and at the voltage value VS are outputted by aforementiond row driver IC to the scanning electrode TP1, and thereafter a pause period t2 (the voltage value 0V) is set. The same pulses are sequentially outputted by the row driver IC also to the scanning electrode TP2. During the remaining period other than that, the pulses at the smallest voltage value VH are outputted. In short, the scanning voltages each composed of two successive pulses at the voltage value VH and at the voltage value VS are sequentially applied to all of the 128 scanning electrodes at an interval of the pause period t2 therebetween.

Further, aforementiond column driver IC outputs the signal voltage according to the image data to the signal electrode SG1, SG2 in synchronization with the output of the scanning voltage composed of the two pulses. More specifically, for the white image (ON), the column driver IC outputs the pulse at the voltage value VD in a period of the first half of the two pulses and the voltage value 0V in a period of the second half of the two pulses. For the black image (OFF), the column driver IC outputs the voltage value 0V in a period of the first half of the two pulses and the pulse at the voltage value VD in a period of the second half of the two pulses.

The same signal voltages are also outputted by the column driver IC to not-shown signal electrodes SG3 to SG160. More specifically, the driver IC outputs the signal voltages according to the image data for the pixels on one line simultaneously and in parallel to the 160 signal electrodes SG1 to SG160 in synchronization with the output of the scanning voltages each composed of two pulses sequentially to the scanning electrodes TP1 to TP128 on each line. However, the pause period t2 during which voltage value is 0V to each of the scanning voltage and the signal voltage is provided between the periods for applying the voltages to the scanning electrodes and the signal electrodes.

Thus, assuming that, for example, the pixel Pix (1, 1) and the pixel Pix (1, 2) shown in FIG. 5 are the first pixel and the second pixel on the first scanning electrode, the selection pulses SPw and SPb in the composite voltage waveform (TP1-SG1) and the composite voltage waveform (TP1-SG2) are applied respectively between the scanning electrode TP1 and the signal electrodes SG1 and SG2 at portions forming the pixels during a period SEL0 in the frame F2 in FIG. 13.

In this example, the pixel Pix (1, 1) to which the selection pulse SPw composed of the pulse at −VH and the pulse at +VS is applied displays the white image, and the pixel Pix (1, 2) to which the selection pulse SPb composed of the pulse at +VH and the pulse at +VD is applied displays the black image.

During the period SEL0, either the selection pulse SPw or SPb is applied between the first line of the scanning electrodes and all of the signal electrodes, that is, to the pixels Pix (1, 1) to Pix (1, 160), whereby the pixels Pix (1, 1) to Pix (1, 160) display white or black.

During a next period SEL1, either the selection pulse SPw or SPb is applied between the second line of the scanning electrodes and all of the signal electrodes, that is, to the pixels Pix (2, 1) to Pix (2, 160), whereby the pixels Pix (2, 1) to Pix (2, 160) display white or black.

In this manner, either the selection pulse SPw or SPb is applied between the last line of the scanning electrodes and all of the signal electrodes, that is, to the pixels Pix (128, 1) to Pix (128, 160) sequentially line by line, whereby the image on the whole screen is rewritten. The pause period t2 is provided between every selection pulse and the next selection pulse.

The reason why the pause period t2 is provided is to surely prevent occurrence of an error image. If the scanning voltage and the signal voltage in the voltage waveforms generating the selection pulse are sequentially applied respectively to the scanning electrodes and the signal electrodes without the pause period, the signal voltage is composed of two successive pulses at the voltage value VD depending on the image data, for example, when the white image is subsequent to the black image, and applied to the signal electrode. The voltage value VD having a double time width is close to VS having a voltage width that is double the voltage width of the voltage value VD, so that an error image can occur.

However, the pause period t2 during which a voltage value 0V is applied to both of the scanning electrode and the signal electrode is provided after the selection pulse is applied as in this embodiment, whereby two successive pulses at the voltage value VD are no longer applied to the signal electrode to avoid the possibility of display an error image.

If the pause period t2 is too short, the effect to prevent the error image is insufficient, so that it is desirable to set the pause period t2 to be equal to or greater than the width of one pulse of the selection pulse (being the same as the width of one pulse of each of the voltage waveforms to be applied to the scanning electrode and the signal electrode).

On the other hand, if the pause period t2 is too long, the period of the frame F2 becomes long to slow the rewrite of the screen, so that the pause period t2 is set to be an appropriate length. For example, when the width of one pulse of the selection pulse is 1.5 msec, the pause period t2 is preferably set to be about 2 msec to about 10 msec.

Incidentally, when the pause period t2 is provided in the selection period (frame F0) as described above, it may be preferable to also provide the pause period t0 in the correction period and the pause period t1 in the reset period (frame F1) as shown in FIG. 13 in designing the driving circuit (driver IC).

The pause periods t0 and t1 in that case may be shorter than the pause period t2 in the selection period and is preferably as short as possible. This ensures that even when the periods of the frames F0 and F1 are set to be shorter than the period of the frame F2 and the pause period is provided in the selection period in order to reduce the error image, the time for updating the screen does not become so long.

Further, as a matter of course, the correction pulses in the correction period (frame F0) and the reset pulses in the reset period (frame F1) as in the embodiment described with FIG. 12 may be simultaneously applied to all of the scanning electrodes and all of the signal electrodes. In that case, the time for updating the screen can be further reduced.

Although the case in which the ferroelectric liquid crystal is used for the liquid crystal layer with a memory effect of the liquid crystal panel with a memory effect has been described in each of the embodiments, other liquid crystal having a memory effect such as a cholesteric liquid crystal and the like may be used. In that case, the above-described absolute values of the voltage values VH, VD and VS can be set in consideration of the threshold voltage values at which the stable state of the liquid crystal having a memory effect in use changes.

The liquid crystal display device according to the invention can be used for various kinds of devices for displaying static images with low frequency of rewriting, and is particularly useful for the display device of a personal digital assistant. Especially suitable for a terminal device which is required to be continuously used for a long time even when driven with batteries, such as an electronic book and an electronic dictionary. Further, the liquid crystal display device, in which rewriting of screen is not so often, can realize excellent display medium without flicker of the screen.

What is claimed is:

1. A liquid crystal display device comprising a liquid crystal panel with a memory effect including a liquid crystal having a memory effect having at least bistable states sandwiched between a pair of substrates having scanning electrodes and signal electrodes on opposed surfaces respectively, portions thereof where said scanning electrodes are opposed to said signal electrodes with said liquid crystal intervening therebetween forming pixels; and a driving circuit for driving said liquid crystal panel with a memory effect to cause said pixels to display image data, wherein said driving circuit applies, to said scanning electrode of said liquid crystal panel with a memory effect, a scanning voltage in a voltage waveform composed of a voltage value 0V and only one of a positive or negative unipolar voltage value consistently across a plurality of scanning periods, and also, to said signal electrode, a signal voltage in a voltage waveform composed of a voltage value 0V and a unipolar voltage value having the same polarity as the polarity of the scanning voltage consistently across a plurality of scanning periods, wherein the image data displayed at said pixel is displayed during a plurality of scanning periods, and the voltage applied between said scanning electrode and said signal electrode at a portion forming said pixel is made alternation in the plural scanning periods, and wherein one scanning period of the plural scanning periods has a selection period for applying a selection pulse between said electrodes to cause said pixel to display, a scanning period placed before said scanning period having the selection period has a reset period for applying a reset pulse between said electrodes to reset a state of said pixel before said selection period, and a scanning period placed before said scanning period having the reset period has a correction period for applying a correction pulse for the alternation.

2. The liquid crystal display device according to claim 1, wherein a composite waveform of the voltage waveform of the scanning voltage and the voltage waveform of the signal voltage outputted by said driving circuit is a waveform of a composite voltage applied between said scanning electrode and signal electrode at the portion forming said pixel, wherein said liquid crystal having a memory effect at said pixel is bring into one stable state of bistable states in the correction period of the plural scanning periods, said liquid crystal having a memory effect is bring into the other stable state in the reset period, and said liquid crystal having a memory effect is bring into the one or the other stable state in the selection period.

3. The liquid crystal display device according to claim 2, wherein the waveform of the composite voltage has the correction pulse in the correction period, has the reset pulse in the reset period, and the selection pulse in the selection period, wherein the correction pulse is mainly composed of the voltage waveform of scanning voltage, wherein the reset pulse is composed of the voltage waveform of the signal voltage with the scanning voltage being 0V, wherein the selection pulse is composed of the voltage waveform of the signal voltage and the voltage waveform of the scanning voltage.

4. The liquid crystal display device according to claim 1, wherein the reset pulse has an actual pulse width at least equal with the selection pulse.

5. The liquid crystal display device according to claim 1, wherein the scanning voltage and the signal voltage in the voltage waveforms generating the pulses are applied to said scanning electrodes and said signal electrodes respectively line by line in the correction period, the reset period and the selection period.

6. The liquid crystal display device according to claim 1, wherein each of the voltage waveform of the scanning voltage and the voltage waveform of the signal voltage outputted by said driving circuit is composed of four values which are a first positive or negative voltage value (VS) that is larger in absolute value than a threshold value at which the stable state of said liquid crystal having a memory effect changes, a second voltage value (VD) that is the same in polarity as the first voltage value and smaller in absolute value than the threshold value, a third voltage value (VH) that is the same in polarity as the second voltage value and smaller in absolute value than the second voltage value, and a voltage value 0V.

7. The liquid crystal display device according to claim 6, wherein the second voltage value (VD) is ½ of the first voltage value (VS), and the third voltage value (VH) is ¼ of the first voltage value (VS).

8. The liquid crystal display device according to claim 6, wherein in the selection period, the voltage waveform of the signal voltage is composed of the second voltage value (VD) and the voltage value 0V.

9. The liquid crystal display device according to claim 8, wherein in the selection period, the voltage waveform of the scanning voltage has the selection pulse composed of only the first voltage value (VS) and is composed of the third voltage value (VH) and the voltage value 0V in a period other than the selection pulse.

10. The liquid crystal display device according to claim 6, wherein in the correction period, the reset period and the selection period, reference potentials of the scanning voltage and the signal voltage outputted by said driving circuit are 0V at all times.

11. The liquid crystal display device according to claim 1, wherein any of the correction period, the reset period and the selection period is one scanning period in which the whole screen of said liquid crystal panel with a memory effect is rewritten one time.

12. The liquid crystal display device according to claim 1, wherein the correction pulse is applied between electrodes of said scanning electrode and said signal electrode in the correction period, the reset pulse is applied between said electrodes in the reset period, and the correction pulses and the reset pulses are simultaneously applied to all of said scanning electrodes and said signal electrodes respectively.

13. The liquid crystal display device according to claim 1, wherein a pause period during which a voltage value 0V is applied to both of said scanning electrode and said signal electrode is provided immediately after the selection pulse is applied in the selection period.

14. The liquid crystal display device according to claim 13, wherein the pause period is a period equal to or greater than a width of one pulse of the selection pulse.

15. The liquid crystal display device according to claim 1, wherein said driving circuit comprises a scanning electrode driving circuit for applying the scanning voltage to said scanning electrode; and a signal electrode driving circuit for applying the signal voltage to said signal electrode, wherein said scanning electrode driving circuit and said signal electrode driving circuit have the same circuit configuration and are compatible with each other.

* * * * *